US010493505B2

(12) United States Patent
Smith

(10) Patent No.: US 10,493,505 B2
(45) Date of Patent: Dec. 3, 2019

(54) FUME HOOD WITH HORIZONTALLY MOVEABLE PANELS

(71) Applicant: 3Flow, Inc., Cary, NC (US)

(72) Inventor: Thomas C. Smith, Raleigh, NC (US)

(73) Assignee: 3Flow, Inc., Cary, NC (US)

( * ) Notice: Subject to any disclaimer, the term of this patent is extended or adjusted under 35 U.S.C. 154(b) by 491 days.

(21) Appl. No.: 15/182,103

(22) Filed: Jun. 14, 2016

(65) Prior Publication Data

US 2017/0354998 A1 Dec. 14, 2017

(51) Int. Cl.
*B08B 15/02* (2006.01)

(52) U.S. Cl.
CPC ..... *B08B 15/023* (2013.01)

(58) Field of Classification Search
CPC ..... B08B 15/023
USPC ..... 454/56, 63, 66
See application file for complete search history.

(56) References Cited

U.S. PATENT DOCUMENTS

| | | | |
|---|---|---|---|
| 2,702,505 A | 2/1955 | Nelson | |
| 2,819,666 A | 1/1958 | McNeil et al. | |
| 3,000,292 A | 9/1961 | Wojan | |
| 3,111,077 A | 11/1963 | Cortright | |
| 3,217,630 A | 11/1965 | Katzfey et al. | |
| 3,218,953 A | 11/1965 | Grow et al. | |
| 3,237,548 A | 3/1966 | Bayern | |
| 3,254,588 A | 6/1966 | Truhan | |
| 3,318,227 A | 5/1967 | Nelson et al. | |
| 3,747,504 A | 7/1973 | Turko et al. | |
| 3,897,721 A | 8/1975 | Fuhst | |
| 4,023,473 A | 5/1977 | Russell | |
| 4,100,847 A | 7/1978 | Norton | |
| 4,142,458 A * | 3/1979 | Duym | B08B 15/023 422/567 |

(Continued)

FOREIGN PATENT DOCUMENTS

| | | |
|---|---|---|
| GB | 1146778 A | 3/1967 |
| GB | 2 112 129 A | 7/1983 |

OTHER PUBLICATIONS

International Preliminary Report on Patentability Corresponding to International Application No. PCT/US2011/045648; dated Jan. 3, 2013; 6 Pages.

(Continued)

*Primary Examiner* — Gregory L Huson
*Assistant Examiner* — Dana K Tighe
(74) *Attorney, Agent, or Firm* — Myers Bigel, P.A.

(57) ABSTRACT

A fume hood adapted to be connected to an exhaust system has a ventilated chamber having an access opening, and at least one horizontally sliding sash or panel at the access opening that is configured to cover and uncover portions of the access opening. Each horizontally sliding panel has a peripheral edge that convexly curves into the chamber towards a centerline of the at least one horizontally sliding panel. In some embodiments, the peripheral edge is convexly curved in an arc of between about ninety degrees and about one hundred eighty degrees (90°-180°). The exhaust system creates air flow into the chamber and the curved peripheral edge produces controlled air flow patterns into the chamber. The curved edge is aerodynamically designed to help shed vortices and prevent accumulation of concentrations on the inside edge of the each panel typical of conventional fume hood sashes/panels.

26 Claims, 20 Drawing Sheets

(56) References Cited

U.S. PATENT DOCUMENTS

| | | | |
|---|---|---|---|
| 4,177,717 | A | 12/1979 | Grow et al. |
| 4,177,718 | A | 12/1979 | Grow et al. |
| 4,280,400 | A | 7/1981 | Longworth |
| 4,377,969 | A | 3/1983 | Nelson |
| 4,434,711 | A | 3/1984 | Zboralski et al. |
| 4,451,000 | A | 5/1984 | Stephens |
| 4,534,281 | A | 8/1985 | Parks et al. |
| D286,324 | S | 10/1986 | Parks et al. |
| 4,785,722 | A | 11/1988 | Dollhopf et al. |
| 4,856,420 | A | 8/1989 | Poblete et al. |
| 4,934,256 | A | 6/1990 | Moss et al. |
| 5,042,456 | A | 8/1991 | Cote |
| 5,167,677 | A | 12/1992 | Hammes |
| D346,437 | S | 4/1994 | Poblete et al. |
| 5,334,089 | A | 8/1994 | Beck et al. |
| 5,378,195 | A | 1/1995 | Beck |
| 5,407,389 | A | 4/1995 | Poblete et al. |
| 5,413,408 | A | 5/1995 | Beck et al. |
| 5,415,583 | A | 5/1995 | Brandt, Jr. |
| 5,421,379 | A | 6/1995 | Geiser |
| D360,682 | S | 7/1995 | Gilkison et al. |
| 5,447,468 | A | 9/1995 | Tener et al. |
| 5,582,472 | A | 12/1996 | Lyons et al. |
| 5,688,168 | A | 11/1997 | Schlies |
| 5,697,838 | A | 12/1997 | Morris |
| 5,716,267 | A | 2/1998 | Hambleton et al. |
| 5,718,626 | A | 2/1998 | Rindoks et al. |
| 5,797,790 | A | 8/1998 | Rindoks et al. |
| 5,924,920 | A | 7/1999 | DeLuca et al. |
| 6,004,095 | A | 12/1999 | Waitz et al. |
| 6,089,970 | A | 7/2000 | Feustel |
| 6,131,463 | A | 10/2000 | Morris |
| 6,302,779 | B1 | 10/2001 | Ryan et al. |
| 6,350,194 | B1 | 2/2002 | Haugen et al. |
| 6,368,206 | B1 | 4/2002 | Hunter et al. |
| 6,428,408 | B1 | 8/2002 | Bell et al. |
| 6,450,875 | B1 | 9/2002 | Haugen |
| 6,461,233 | B1 | 10/2002 | Gilkison et al. |
| 6,506,109 | B1 | 1/2003 | Bastian et al. |
| D472,645 | S | 4/2003 | Roepke et al. |
| 6,569,007 | B2 | 5/2003 | Bastian et al. |
| 6,582,292 | B1 | 6/2003 | Bastian |
| 6,692,346 | B2 | 2/2004 | Bastian et al. |
| 6,814,658 | B1 | 11/2004 | Rindoks et al. |
| 7,318,771 | B2 | 1/2008 | Huang et al. |
| RE40,276 | E | 4/2008 | Hunter et al. |
| 7,470,176 | B2 | 12/2008 | Morris et al. |
| 9,056,339 | B2 | 6/2015 | Smith et al. |
| 2003/0027515 | A1 | 2/2003 | Ryan et al. |
| 2003/0109211 | A1 | 6/2003 | Bastian |
| 2004/0082292 | A1 | 4/2004 | Ryan et al. |
| 2005/0164622 | A1 | 7/2005 | Ryan et al. |
| 2007/0021046 | A1 | 1/2007 | Huang et al. |
| 2007/0021047 | A1 | 1/2007 | Huang et al. |
| 2007/0087677 | A1 | 4/2007 | Morris et al. |
| 2007/0093154 | A1 | 4/2007 | Simpson |
| 2008/0014080 | A1 | 1/2008 | Fang |
| 2009/0301485 | A1 | 12/2009 | Kenyon et al. |

OTHER PUBLICATIONS

International Search Report Corresponding to International Application No. PCT/US2011/045648; dated Mar. 8, 2012; 10 pages.

Written Opinion of the International Preliminary Examining Authority Corresponding to International Application No. PCT/US2011/045648; dated Aug. 31, 2012; 5 Pages.

Office Action, Canadian Patent Application No. 2,966.270, dated Apr. 12, 2018, 7 pp.

* cited by examiner

FUME HOOD WITH HORIZONTALLY MOVEABLE PANELS

FIELD OF THE INVENTION

The present invention relates generally to fume hoods and, more particularly, to apparatus for reducing required airflow into fume hoods.

BACKGROUND

Fume hoods are employed in laboratories and other locations where technicians work with materials that generate dangerous or noxious contaminants. Conventional fume hoods include an enclosed chamber in which work is performed. An access opening is provided in the front of the chamber through which a technician can perform work within the chamber. An exhaust system is configured to exhaust air and contaminants from the chamber to a location outside the fume hood. The exhaust system draws air flow through the access opening and out of the chamber. This inward flow of air is intended to prevent contaminants from exiting the chamber through the access opening.

FIG. 1 illustrates a typical conventional fume hood 10. The illustrated fume hood 10 includes a cabinet 12 having a work chamber 14. The chamber 14 includes a flat bottom floor (surface) 16 on which work is performed within the chamber 14 and an access opening 18 at the front of the chamber 14. A sash 20 is mounted in the cabinet 12 for up and down movement in a vertical plane to open and close the access opening 18. The sash 20 is conventionally formed of transparent material, such as glass, to permit viewing of the chamber 14 therethrough.

An average face velocity of about 100 feet per minute (fpm) or greater at the access opening of a fume hood is stipulated by California regulations (CAL-OSHA) in order to prevent harmful contaminants from escaping the chamber through the access opening. This average face velocity of about 100 fpm is also becoming the traditional industry and facility standard. Unfortunately, such an air velocity and resultant air volumes may result in the withdrawal of an equivalent amount of air from the room in which a fume hood is located. Since the supply air in most laboratories is heated and cooled and is 100% outdoor air, it is desirable to reduce the amount of conditioned air that is drawn through the fume hoods. It is estimated by some that the cost of moving conditioned air (i.e., heated and cooled air) drawn through a conventional fume hood may exceed $5,000 per year.

SUMMARY

It should be appreciated that this Summary is provided to introduce a selection of concepts in a simplified form, the concepts being further described below in the Detailed Description. This Summary is not intended to identify key features or essential features of this disclosure, nor is it intended to limit the scope of the invention.

According to some embodiments of the present invention, a fume hood adapted to be connected to an exhaust system has a ventilated chamber having an access opening, and at least one horizontally sliding sash or panel at the access opening that is configured to cover and uncover portions of the access opening. Each horizontally sliding panel has a peripheral edge that convexly curves into the chamber towards a centerline of the at least one horizontally sliding panel. In some embodiments, the peripheral edge is convexly curved in an arc of between about ninety degrees and about one hundred eighty degrees (90°-180°).

The exhaust system creates air flow into the chamber and the curved peripheral edge produces controlled air flow patterns into the chamber. The curved edge is aerodynamically designed to help shed vortices and prevent accumulation of concentrations on the inside edge of the each panel typical of conventional fume hood sashes/panels. The curved peripheral edge, along with the width and height of each panel, are ergonomically superior to common panels that are often sharp edged and too wide or too narrow to reach around and use as an effective shield to prevent being splashed or to stop and divert explosive flying debris. Horizontally sliding panels according to embodiments of the present invention in combination with a conventional vertical sash enable multiple configurations for users to maximize access into a hood and provide greater protection.

In some embodiments, a sensor or monitor can be installed to detect removal of a horizontal panel and/or an unsafe reduction in air flow or inadequate face velocity.

In some embodiments, each horizontally sliding panel is supported at an upper portion thereof and is inwardly tiltable and removable by a person without the use of tools. Each horizontal panel can be removed by simply lifting the panel up, tilting the bottom of the panel forward and gently pulling the panel down.

In some embodiments, the fume hood further includes a horizontal track disposed above the chamber access opening. A pair of spaced support rollers are connected to an upper portion of each horizontally sliding panel and are engagable with the horizontal track to permit horizontal sliding movement of each horizontally sliding panel.

In some embodiments, each horizontally sliding panel includes a guide member extending downwardly from a lower portion thereof that cooperates with a lower portion of the chamber.

The fume hood chamber includes a work space floor, and an edge portion of the floor extends outwardly to the access opening. In some embodiments, an elongated airfoil assembly is attached to the floor edge portion, and each horizontally sliding panel includes a guide member extending downwardly from a lower portion thereof that cooperates with an elongated slot in the elongated airfoil assembly.

Various numbers of horizontally sliding panels may be utilized in accordance with embodiments of the present invention. For example, in some embodiments, a single horizontally sliding panel may be utilized. In other embodiments, a pair of horizontally sliding panels may be utilized, each panel configured to slide within the same plane. In other embodiments, two (or more) pair of horizontally sliding panels may be utilized, and wherein the panels in each pair are arranged in bypass relation so as to slide in different respective planes.

In some embodiments of the present invention, at least a portion of each horizontally sliding panel is transparent. For example, a panel may include one or more safety glass panels. In addition, each horizontally sliding panel is formed of a rigid material, an exemplary material being stainless steel.

In addition to a work space floor and access opening, the fume hood chamber also includes a rear wall, side walls, and a ceiling. In some embodiments, the fume hood also includes a baffle assembly located in front of the chamber rear wall. The baffle assembly includes a lower panel and an upper panel. The lower panel has opposite side edges attached to the respective chamber side walls and a lower edge spaced apart from the chamber floor. The upper panel has opposite side edges attached to the respective chamber side walls, a lower edge attached to an upper portion of the lower panel, and an opposite upper edge attached to the chamber ceiling. Both the upper and lower panels include a plurality of air-exit apertures formed therethrough.

In some embodiments, the upper and lower panels are generally rectangular and are formed from rigid material.

In some embodiments, the baffle assembly further includes an elongated grating covering a gap between the lower panel lower edge and the chamber floor.

A horizontally sliding panel, according to embodiments of the present invention, may have various shapes and configurations. In one embodiment, a horizontally sliding panel has a generally rectangular shape with opposite side edges and opposite upper and lower edges. Each edge convexly curves into the chamber towards a centerline of the at least one horizontally sliding panel. Typically, each edge is convexly curved in an arc of between about ninety degrees and about one hundred eighty degrees (90°-180°). When installed in a fume hood, the upper edge of the rectangular panel is spaced apart from an upper portion of the access opening of the fume hood, and the lower edge of the rectangular panel is spaced apart from a lower portion of the access opening of the fume hood.

According to other embodiments of the present invention, a fume hood adapted to be connected to an exhaust system includes a ventilated chamber having an access opening, a vertically sliding sash at the access opening that is movable between raised and lowered positions, and at least one horizontally sliding panel (e.g., a pair or two pair of panels) at the access opening that is movable independently of the vertically sliding sash and that is configured to cover and uncover portions of the access opening. Each horizontally sliding panel has a peripheral edge that convexly curves into the chamber towards a centerline of the at least one horizontally sliding panel. In some embodiments, the peripheral edge is convexly curved in an arc of between about ninety degrees and about one hundred eighty degrees (90°-180°). Typically, at least a portion of each horizontally sliding panel is transparent (e.g., includes one or more safety glass panels).

In some embodiments, each horizontally sliding panel is positioned behind the vertically sliding sash.

In some embodiments, the vertically sliding sash has an elongated airfoil assembly attached to a lower edge portion thereof. The shape of each aerodynamic horizontal sliding panel complements the aerodynamic design of the vertical sash airfoil assembly and an airfoil assembly attached to the chamber floor edge portion.

According to other embodiments of the present invention, a fume hood adapted to be connected to an exhaust system includes a ventilated chamber having a rear wall, side walls, a ceiling, a floor and an access opening. A baffle assembly is located in front of the rear wall and includes lower and upper panels. The lower panel has opposite side edges attached to the respective chamber side walls and a lower edge spaced apart from the chamber floor. In addition, a plurality of air-exit apertures are formed within the lower panel. The upper panel has opposite side edges attached to the respective chamber side walls, a lower edge attached to an upper portion of the lower panel, and an opposite upper edge attached to the chamber ceiling. In addition, a plurality of air-exit apertures are formed within the upper panel. In some embodiments, the upper and lower panels are generally rectangular.

In some embodiments, the baffle assembly further includes an elongated grating covering a gap between the lower panel lower edge and the chamber floor.

The aerodynamic horizontal sliding panel and baffle assembly of the present invention can reduce the air velocity and volumes required for safe operation of fume hoods and can improve the containment of contaminants therewithin. In addition, fume hoods fitted with a baffle assembly and at least one aerodynamic horizontal sliding panel of the present invention can have equivalent openings as conventional fume hoods and still meet safety requirements at lower flow and face velocities.

In addition, the horizontally sliding panels of the present invention provide greater flexibility and safety for a fume hood user. Many conventional vertical sash fume hoods have a restricted height opening preventing users from reaching equipment in the top of the hood. Opening a vertical sash to full open jeopardizes containment for traditional fume hoods and even some new high performance fume hoods. However, the horizontally sliding panels of the present invention permit opening a vertical sash to full open while preserving containment.

Furthermore, the ergonomic panels of the present invention with leak tight safety glass panels also provide effective barriers to provide better protection of a user when they stand in front of the panels and reach around into the fume hood chamber. Spills, splashes, fires and explosions are common, and the safety glass and rigid structure provides a greater degree of protection than available in conventional fume hoods.

It is noted that aspects of the invention described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail below.

BRIEF DESCRIPTION OF THE DRAWINGS

The accompanying drawings, which form a part of the specification, illustrate various embodiments of the present invention. The drawings and description together serve to fully explain embodiments of the present invention.

DETAILED DESCRIPTION

Figure 1:
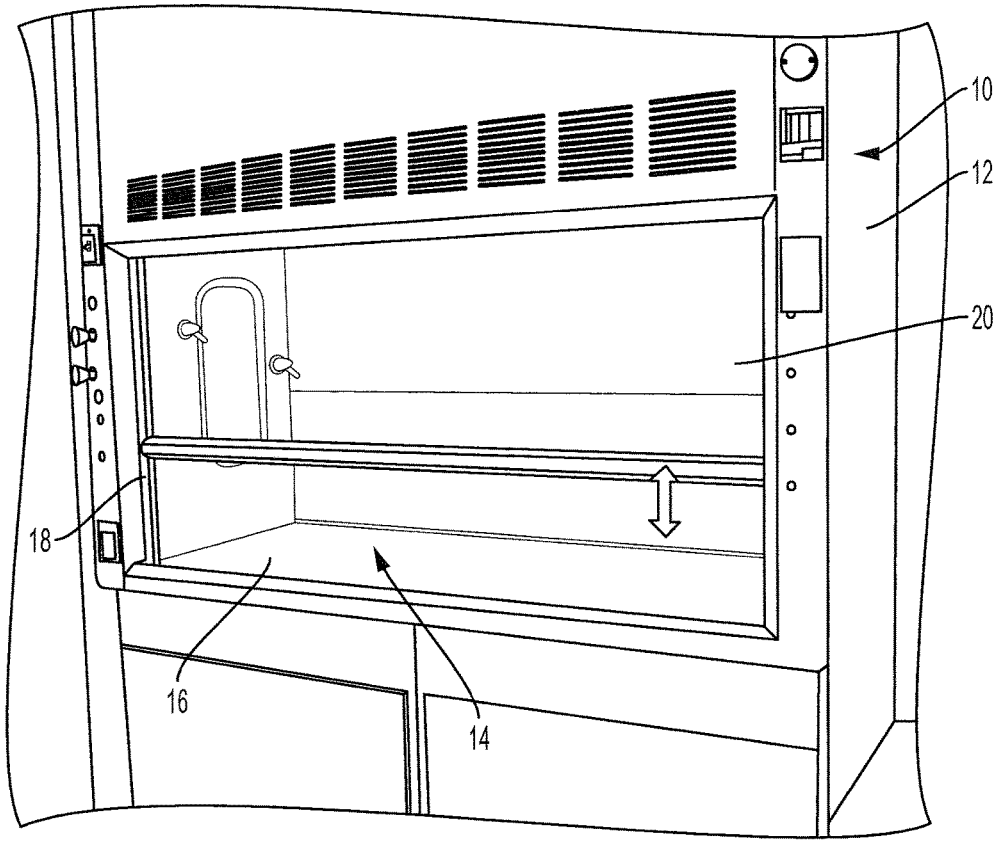
FIG. 1 PRIOR ART
FIG. 1 is a perspective view of a conventional fume hood.

The present invention will now be described more fully hereinafter with reference to the accompanying figures, in which embodiments of the invention are shown. This invention may, however, be embodied in many different forms and should not be construed as limited to the embodiments set forth herein. In the figures, certain features or elements may be exaggerated for clarity, and broken lines, if present, may illustrate optional features or operations unless specified otherwise. Features described with respect to one figure or embodiment can be associated with another embodiment or figure although not specifically described or shown as such.

It will be understood that when a feature or element is referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under.

The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

It will be understood that although the terms first and second are used herein to describe various features/elements, these features/elements should not be limited by these terms. These terms are only used to distinguish one feature/element from another feature/element. Thus, a first feature/element discussed below could be termed a second feature/element, and similarly, a second feature/element discussed below could be termed a first feature/element without departing from the teachings of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

Referring now to FIGS. 2-13, a fume hood 100 that reduces the amount of air required to flow therein, according to some embodiments of the present invention, is illustrated. The illustrated fume hood 100 includes a cabinet 102 having a ventilated work chamber 104 (i.e., the chamber 104 is in communication with an exhaust system 105). The chamber 104 has a rear wall 106, side walls 108, a ceiling 110, a floor 112 on which work is performed within the chamber 104 and an access opening 118 at the front of the chamber 104. A sash 116 is slidably mounted to the chamber 104 at the access opening 118 and is movable between raised (FIG. 3A) and lowered (FIG. 3B) positions. The sash 116 consists primarily of a clear panel 117 formed of glass or any other desired material so that users of the fume hood 100 can see into the chamber 104 through the clear panel 117. The sash 116 may also include a handle 119, as shown in FIGS. 3A and 3B, for moving the sash 116 up and down in its vertical plane of movement.

The fume hood 100 includes airfoil assemblies 130, 200 and a baffle assembly 300 that further help reduce the amount of air flow required to be pulled into the chamber for the fume hood to operate safely. The airfoil assemblies 130, 200 and baffle assembly 300 are described below.

The illustrated fume hood 100 also includes a pair of horizontally sliding sashes or panels 400 at the access opening that are configured to cover and uncover portions of the access opening 118. The panels 400 are top hung on rollers that permit horizontal movement across the face of the hood 100. The vertical sliding sash 116 is unaffected and opens and closes in front of the horizontally sliding panels 400. As will be described below, the horizontally sliding panels have an aerodynamic shape that complements the aerodynamic shapes of the airfoils 130, 200 to enhance contaminant containment, dilution, capture and removal. The horizontally sliding panels 400 in combination with the vertical sash 116 enable multiple opening configurations for users to maximize access into a fume hood and provide greater protection than conventional fume hoods.

The illustrated fume hood 100 is connected to an exhaust system 105. As would be understood by those skilled in the art of the present invention, the exhaust system 105 consists of a conduit and a blower that draw air (and contaminants) outwardly from the chamber 104 and transport the air away from the fume hood 100 to a safe location. As used herein, the term "ventilated chamber" means a fume hood chamber that is adapted to be connected to an exhaust system.

Figure 3A:
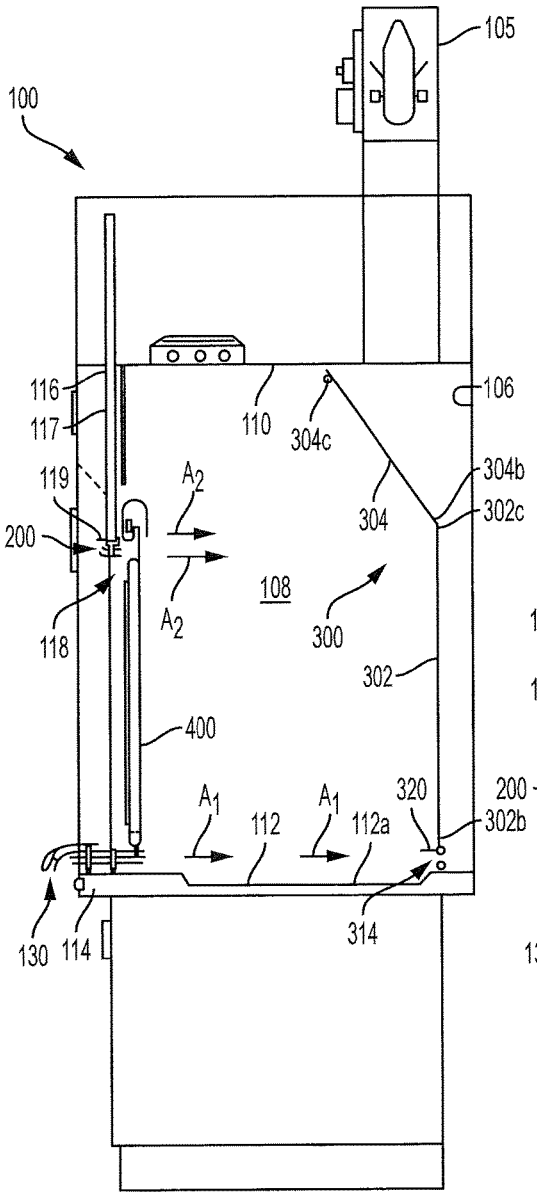
FIG. 3A is a side, cross sectional view of the fume hood of FIG. 2 with the vertical sash in an open position.
Figure 3B:
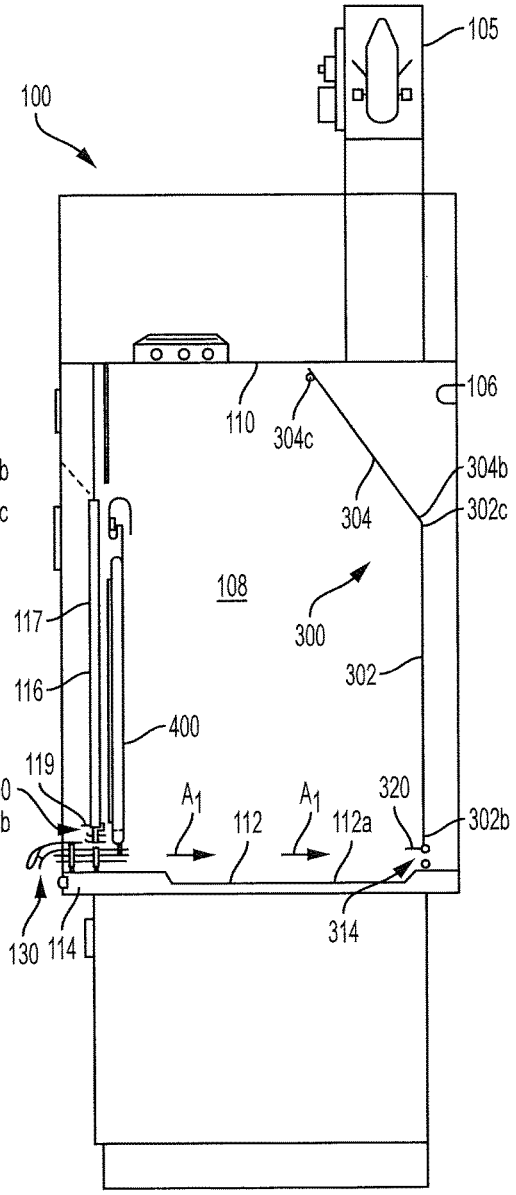
FIG. 3B is a side, cross sectional view of the fume hood of FIG. 2 with the vertical sash in a closed position.

As illustrated in FIGS. 3A and 3B, an edge portion 114 of the work space floor 112 extends outwardly to the access opening 118, and an elongated airfoil assembly 130 is attached to the floor edge portion 114. The airfoil assembly 130 may extend substantially the entire span of the access opening. The airfoil assembly 130 has a low profile such that it does not hinder use of the fume hood 100 and does not form a barrier to the movement of objects into and out of the chamber 104. However, embodiments of the present invention do not require an airfoil assembly 130 attached to the floor edge portion 114.

Figure 12:
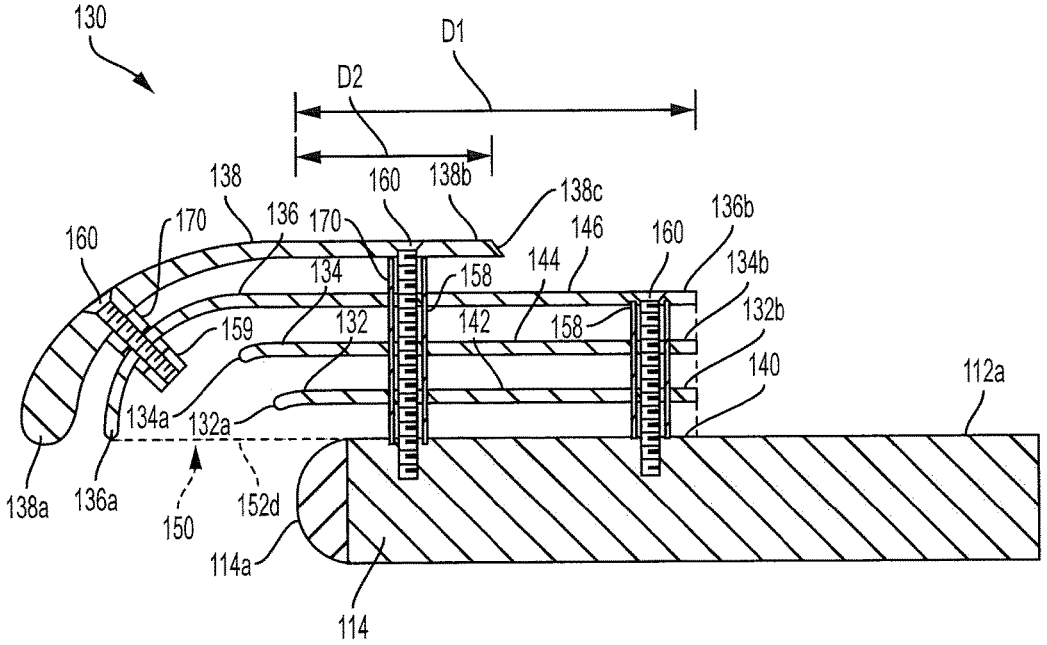
FIG. 12 is a side, cross-sectional view of an elongated airfoil assembly attached to the floor edge portion of the fume hood of FIG. 4.

Referring to FIG. 12, the illustrated airfoil assembly 130 includes a plurality of elongated vanes 132-138 arranged in vertically spaced-apart relationship to define a plurality of vertically spaced-apart air flow channels 140-146. The air flow channels 140-146 extend into the chamber 104 through the access opening 118 and are substantially parallel with the surface 112*a* of the floor 112. When flow is drawn from the chamber 104 by the exhaust system 105, the airfoil assembly 130 produces controlled air flow patterns (indicated by arrows $A_1$ in FIGS. 3A-3B) that sweep along the floor surface 112*a*. These controlled air flow patterns $A_1$ prevent the accumulation of contaminants at the floor surface 112*a* and also prevent the formation of eddies or vortexes within the chamber and particularly at the access opening 118 which, in conventional fume hoods, can cause noxious contaminants to escape from the chamber 104. Because of the controlled air flow patterns $A_1$ created by the airfoil assembly 130, the amount of air flow required for safe operation of the fume hood 100 can be substantially reduced.

The illustrated airfoil assembly 130 includes first, second, third, and fourth vanes 132, 134, 136, 138. Each elongated vane 132-138 has a respective downwardly curved leading edge portion 132*a*, 134*a*, 136*a*, 138*a* and a respective planar trailing edge portion 132*b*, 134*b*, 136*b*, 138*b*. The vanes 132-138 are arranged in a staggered configuration relative to the free end 114*a* of the floor edge portion 114. The leading edge portion 138*a* of the fourth vane 138 extends furthest from the free end 114*a* of the floor edge portion 114, followed by the leading edge portion 136*a* of the third vane 136, followed by the leading edge portion 134*a* of the second vane 134, and finally by the leading edge portion 132*a* of the first vane 132, as illustrated.

The trailing edge portions 132*b*, 134*b*, 136*b*, 138*b* of the vanes 132-138, when in an installed configuration, are substantially parallel with each other and with the floor surface 112*a* of the fume hood 100. In the illustrated embodiment, the first, second and third vanes 132, 134, 136 have respective trailing edges 132*b*, 134*b*, 136*b* that terminate the same distance $D_1$ from a free end 114*a* of the floor edge portion 114. The fourth vane 138 has a trailing edge 138 that terminates at a location closer to the free end 114*a* of the floor edge portion 114 than the trailing edge portions 132*b*-136*b* of the first, second, and third vanes 132-136. The distance between the free end 114*a* of the floor edge portion 114 and the location where the fourth vane trailing edge portion 138*b* terminates is indicated as $D_2$.

In the illustrated embodiment, the leading edge portions 132*a*, 134*a* of the first and second vanes 132, 134 have a slight downwardly curved configuration compared with the downwardly curved configuration of the leading edges 136*a*, 138*a* of the third and fourth vanes 136, 138. For example, the first and second vane leading edge portions 132*a*, 134*a* each have a radius of curvature of between about one degree and about twenty degrees (1°-20°), and the third and fourth vane leading edge portions 136*a*, 138*a* each have a radius of curvature of between about seventy degrees and about ninety degrees (70°-90°).

In the illustrated embodiment, the fourth vane 138 has a cross-sectional shape of an airfoil with a generally blunt leading edge portion 138*a* that tapers to a trailing edge portion 138*b*. The trailing edge portion 138*b* of the fourth vane terminates at an edge 138*c* with a beveled configuration, as illustrated. The fourth vane 138 has a width $W_4$ that is less than the width $W_3$ of the third vane 136, as illustrated. The first, second and fourth vanes 132, 134, 138 include a pair of spaced-apart apertures 131, as illustrated, that are configured to receive a respective fastener 160 therethrough when the airfoil assembly 130 is attached to the floor leading edge portion 114. The third vane 136 has three spaced-apart apertures 131, as illustrated, that are configured to receive a respective fastener 160 therethrough when the airfoil assembly 130 is attached to the floor leading edge portion 114.

The first, second, third, and fourth elongated vanes 132-138 are secured to the floor edge portion 114 via a plurality of supports 150 that are secured to the floor edge portion 114 in spaced-apart relationship. These supports are described in further detail in U.S. Pat. No. 9,056,339, which is incorporated herein by reference in its entirety.

The components of the airfoil assembly 130 may be formed from various materials that are suitable for use in a fume hood environment. For example, the vanes 132-138 and web member 152, as well as fasteners 160, may be formed from metallic materials, polymeric materials, or some combination of metallic and polymeric materials. Exemplary materials for these components may include, but are not limited to, stainless steel Type 316 or Type 304; fiberglass reinforced polyester (FRP); and painted carbon steel.

Airfoil assembly 130 may have different numbers of vanes and vanes with different configurations than illustrated. For example, in some embodiments, fewer than four vanes may be used (e.g., 3 vanes or 2 vanes). In some embodiments the leading edge of the fourth vane 138 may not have a generally blunt leading edge portion 138*a*.

Referring back to FIGS. 2 and 3A-3B, another elongated airfoil assembly 200 is attached to a lower edge portion 116*a* of the vertically sliding sash 116. The airfoil assembly 200 may extend substantially an entire span of the sash 116. However, embodiments of the present invention do not require an airfoil assembly 200 attached to a lower edge portion 116*a* of the vertically sliding sash 116.

Figure 13:
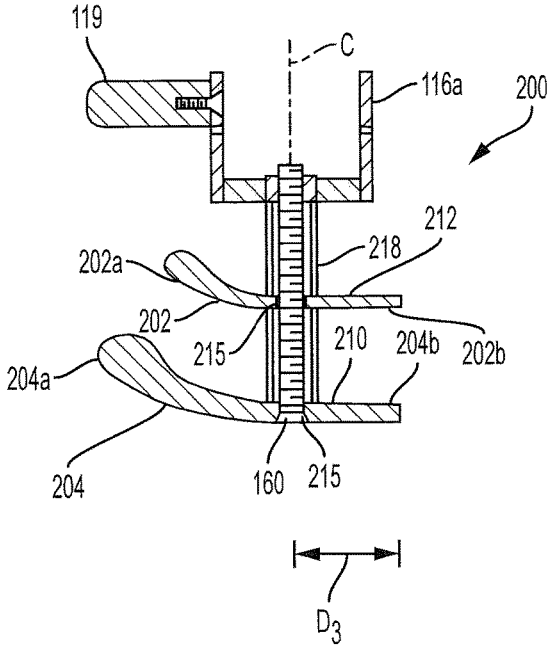
FIG. 13 is a side, cross-sectional view of the elongated airfoil assembly attached to the lower edge portion of the vertically sliding sash of the fume hood of FIG. 4.

Referring to FIG. 13, the illustrated airfoil assembly 200 includes first and second elongated vanes 202, 204 in vertically spaced-apart relationship that define an air flow channels 210, 212 that extend into the chamber 104 through the access opening 118. When airflow is created within the chamber 104 by the exhaust system 105, the airfoil assembly 200 produces controlled air flow patterns (indicated by arrows $A_2$ in FIG. 3A) via the channels 210, 212 that flow into the chamber 104. These controlled air flow patterns $A_2$ prevent the formation of eddies or vortexes in the chamber and particularly at the access opening 118 adjacent to the sash 116 which, in conventional fume hoods, can cause noxious contaminants to escape from the chamber 104. Because of the controlled air flow patterns $A_2$ created by the air foil assembly 200, the amount of air flow required for safe operation of the fume hood 100 can be substantially reduced.

The illustrated airfoil assembly 200 has a low profile and does not interfere with operation of the sash 116 or with the sash handle 119. Moreover, the airfoil assembly 200 is configured such that, when the sash 116 is fully closed, the sash handle 119 mates with the airfoil assembly 130 attached to the floor edge portion 114.

The first and second vanes 202, 204 of the airfoil assembly 200 each have a cross-sectional shape of an airfoil with a generally blunt leading edge portion 202*a*, 204*a* that tapers to a generally planar trailing edge portion 202*b*, 204*b*. The leading edge portions 202*a*, 204*a* are upwardly curved, as illustrated. In the illustrated embodiment, the first and second vanes 202, 204 each have a trailing edge 202*b*, 204*b* that terminates at a location the same distance from a centerline C of the sash (indicated by $D_3$). Also, the first vane 202 has a leading edge portion 202*a* that is located closer to the centerline C of the sash than the leading edge portion 204*a* of the second vane 204, as illustrated.

The first and second vanes 202, 204 have a plurality of apertures 215 formed therethrough in spaced-apart relationship. When the airfoil assembly 200 is installed, apertures in the first and second vanes 202, 204 align with a respective support member 218 and a fastener 160 extends therethrough to secure the airfoil assembly to the sash end portion 116*a*. In some embodiments of the present invention, the number of apertures and support members may be dependent on the opening width of the fume hood chamber. The number of support members and subsequent apertures may be calculated, for example, by the formula: No. of Support Members=(Nominal Hood Width)−1. For example, for a hood having a width of 4 feet, the number of support members will be 3 (i.e., 4−1). Similarly, for a hood having a width of 6 feet, the number of support members will be 5 (i.e., 6−1). In some embodiments of the present invention, the number of apertures may be calculated, for example, by the formula: No. Apertures=No. Support Members+2. The size of the apertures can be determined by equally spacing the support members across the effective width of the fume hood opening.

The various components of the airfoil assembly 200 may be formed from various materials that are suitable for use in a fume hood environment. For example, the vanes 202, 204, support member(s) 218, and fasteners 106 may be formed from metallic materials, polymeric materials, or some combination of metallic and polymeric materials. Exemplary materials include, but are not limited to, stainless steel (e.g., Type 316, Type 304 etc.); fiberglass reinforced polyester (FRP); and painted carbon steel. In some embodiments, the support member 218 is a tubular spacer placed between vanes with an inside diameter sufficient to accept the insertion of fastener 160.

Airfoil assembly 200 may have different numbers of vanes and may have vanes with different configurations than illustrated. For example, in some embodiments, more than two vanes may be used (e.g., 3 vanes). In some embodiments, one or more of the first and second vanes 202, 204 may not have a generally blunt leading edge portion.

Figure 4:
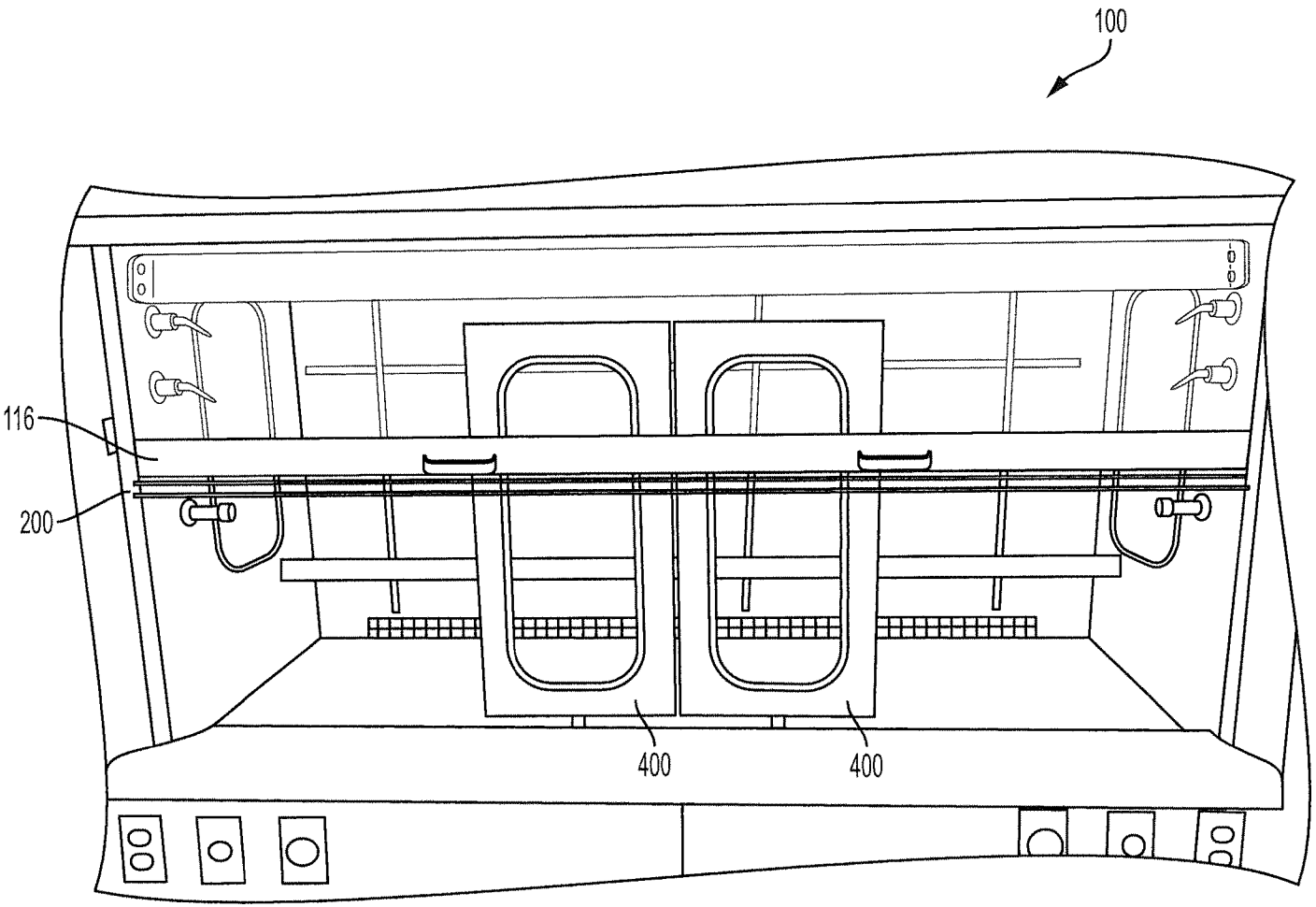
FIG. 4 is a front view of a fume hood having horizontally sliding panels according to some embodiments of the present invention, and wherein the horizontally sliding panels are in adjacent relationship.
Figure 5:
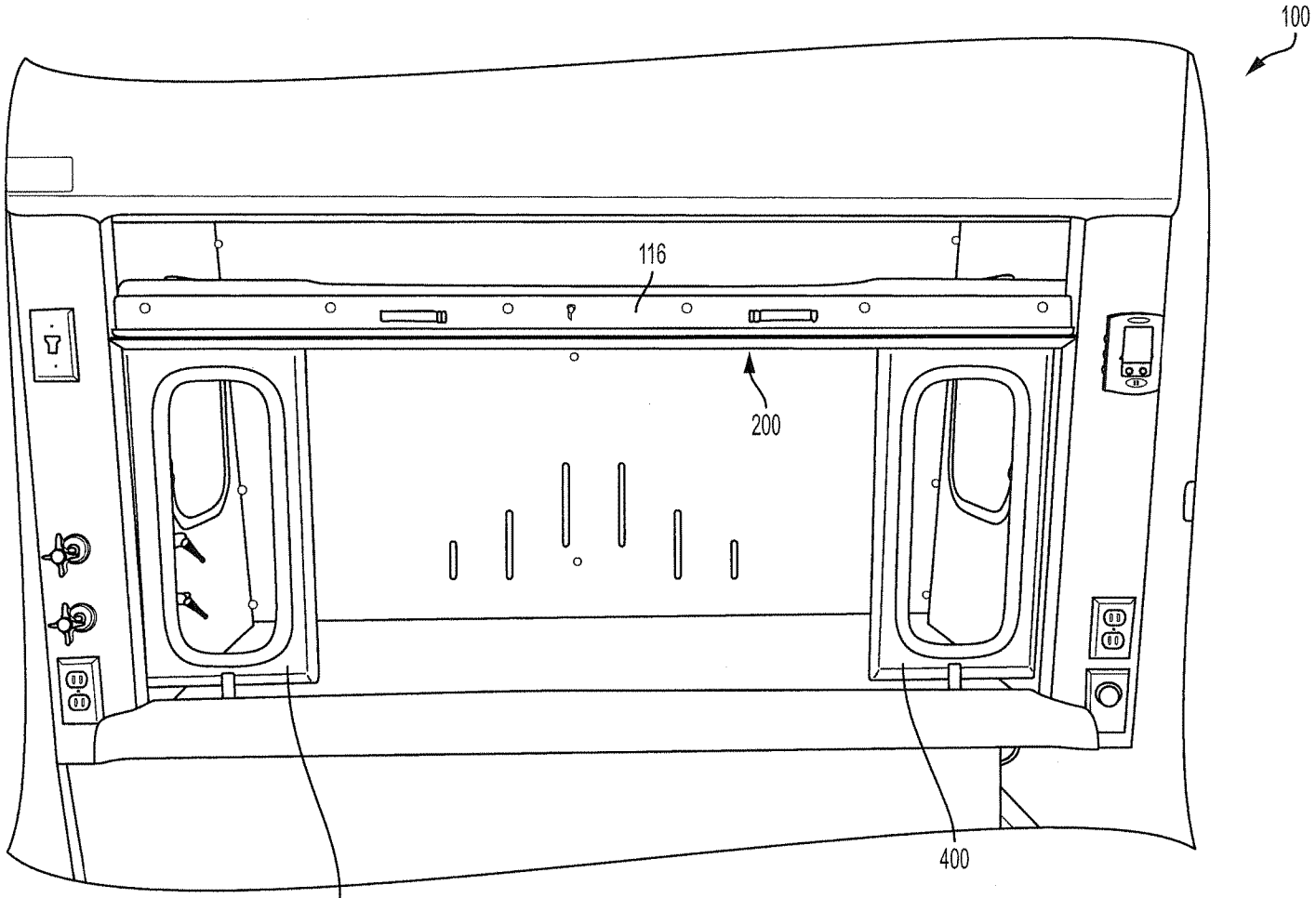
FIG. 5 is a front view of the fume hood of FIG. 4 wherein the horizontally sliding panels are in spaced-apart relationship.
Figure 14:
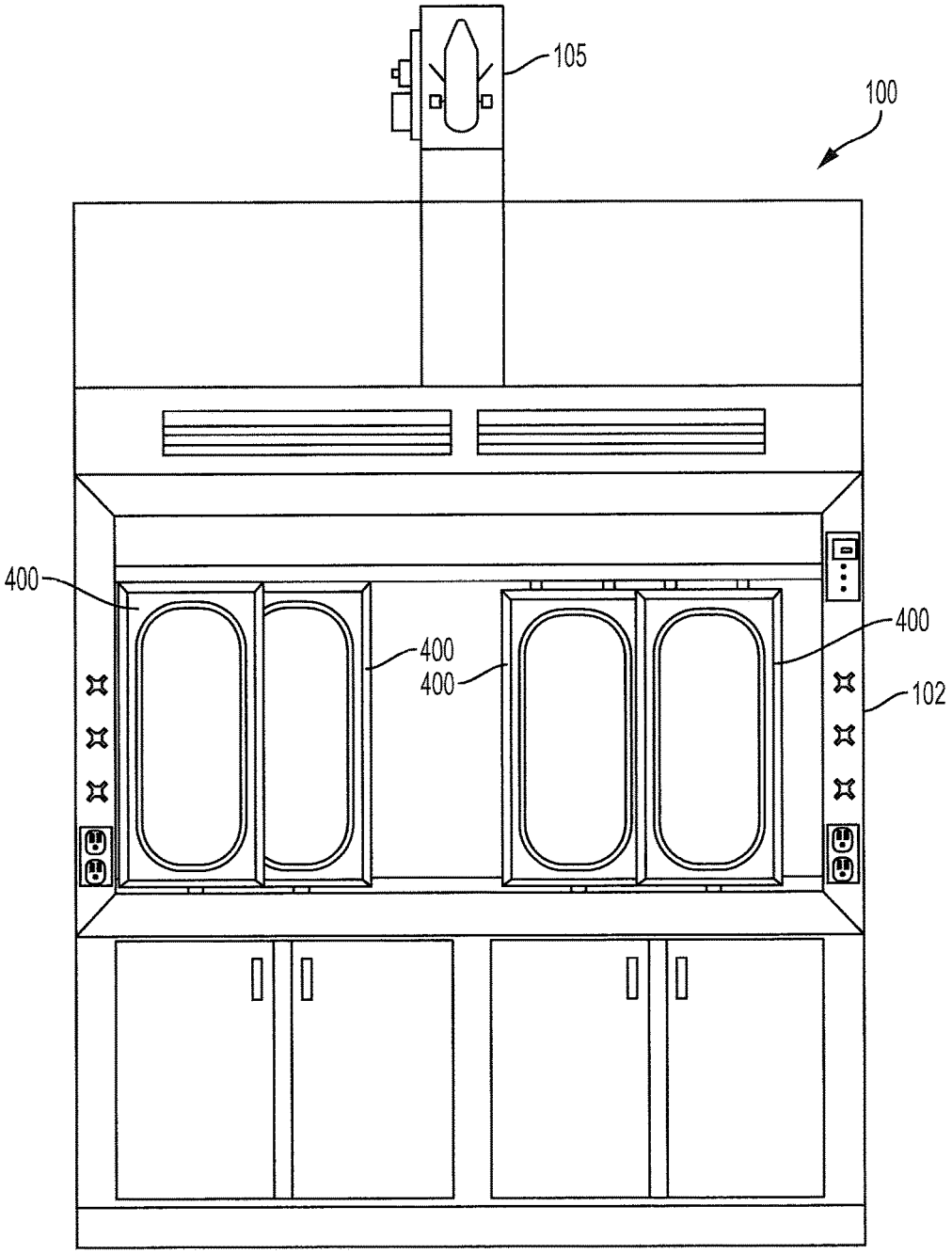
FIG. 14 is a front schematic view of a fume hood having horizontally sliding panels according to other embodiments of the present invention.
Figure 15:
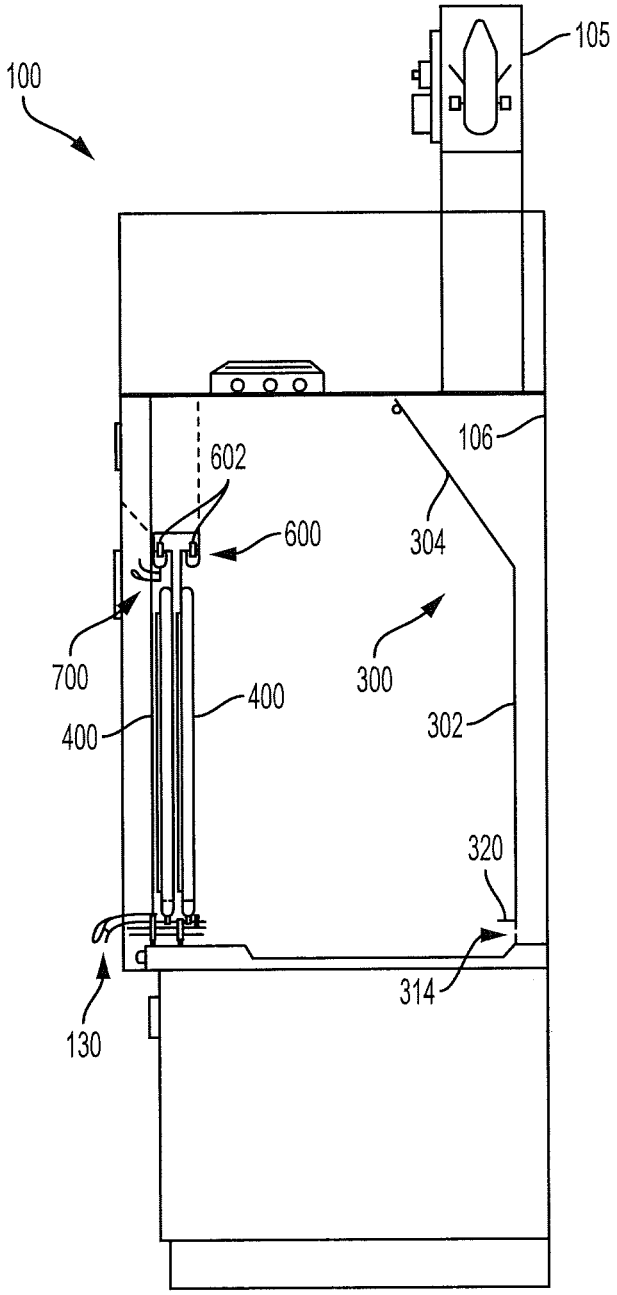
FIG. 15 is a side, cross sectional view of the fume hood of FIG. 14.

Referring back to FIG. 2, the horizontally sliding panels 400 at the access opening 118 are configured to cover and uncover portions of the access opening 118. For example, FIG. 4 is a front view of the fume hood 100 with the horizontally sliding panels 400 in adjacent relationship. FIG. 5 illustrates the horizontally sliding panels 400 in spaced-apart relationship. Various numbers of horizontally sliding panels 400 may be utilized in accordance with embodiments of the present invention. The illustrated embodiment of FIG. 2 includes a pair of panels 400, each configured to slide within the same plane. As illustrated in FIGS. 14-15, two pair of horizontally sliding panels 400 may be utilized. The panels 400 in each pair shown in FIGS. 14-15 are arranged in bypass relation so as to slide in different respective planes. Embodiments of the present invention are not limited to any particular number of horizontally sliding panels 400. Even a single horizontally sliding panel 400 may be utilized in some embodiments of the present invention.

Figure 7A:
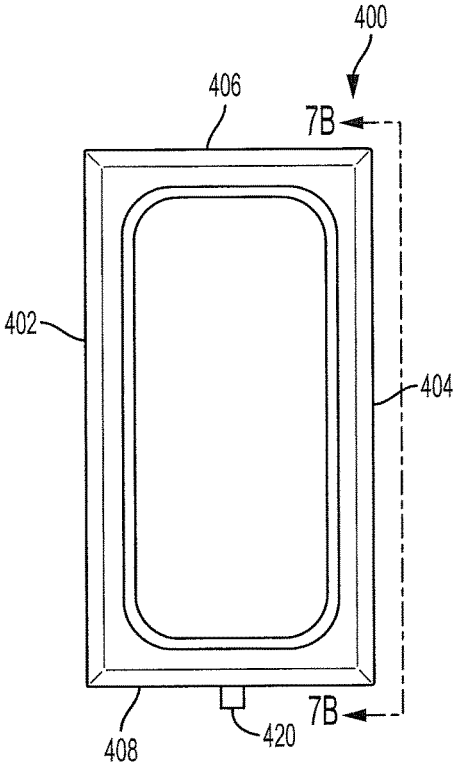
FIG. 7A is a front view of a horizontally sliding panel for a fume hood, according to some embodiments of the present invention.
Figure 7B:
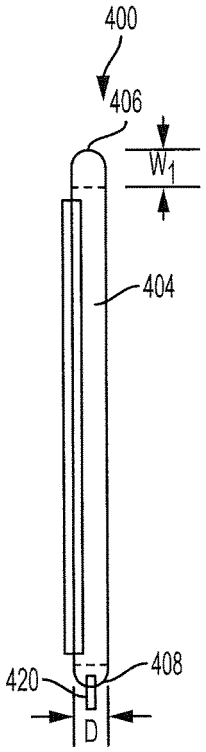
FIG. 7B is a side view of the horizontally sliding panel of FIG. 7A taken along lines 7B-7B.
Figure 7C:
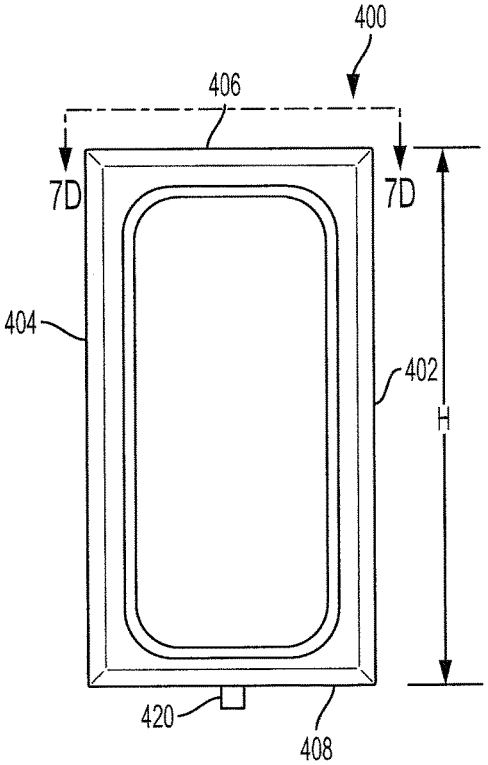
FIG. 7C is a rear view of the horizontally sliding panel of FIG. 7A.
Figure 7D:
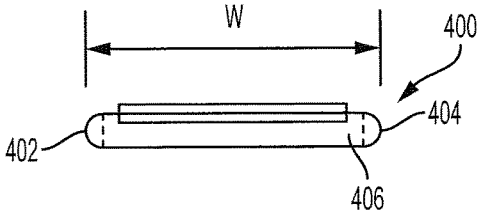
FIG. 7D is a top view of the horizontally sliding panel of FIG. 7C taken along lines 7D-7D.

A horizontally sliding panel 400, according to embodiments of the present invention, may have various shapes and configurations. In the illustrated embodiment, the horizontally sliding panels 400 have a generally rectangular shape with opposite side edges 402, 404 and opposite upper and lower edges 406, 408. As illustrated in FIGS. 7A-7B, each edge 402, 404, 406,408 convexly curves into the chamber 104 towards a centerline of the at least one horizontally sliding panel. Typically, each edge is convexly curved in an arc of between about ninety degrees and about one hundred eighty degrees (90°-180°). In the illustrated embodiment, each edge 402, 404, 406, 408 is convexly curved by about one hundred eighty degrees (180°).

Together, the convexly curved edges 402, 404, 406, 408 may be referred to as a peripheral edge of each horizontally sliding panel 400. In other, non-rectangular embodiments, a peripheral edge of a panel 400 may be continuous and without edges, for example, if the panel 400 has an oval or other non-polygonal shape.

Each illustrated rectangular horizontally sliding panel 400 may have a height H of between about twenty four and thirty six inches (24"-36") and a width W of between about fourteen and twenty four inches (14"-24"). However, other widths and heights are possible, without limitation. In addition, each illustrated horizontally sliding panel 400 may have a depth D of about an inch (1") and each edge 402, 404, 406, 408 may have a width $W_1$ of about one inch (1"). However, other depths and edge widths are possible, without limitation.

The size of the panels 400 can be selected for a respective fume hood so as to enable a flow reduction through the fume hood without reducing the average face velocity. In fact, the horizontally sliding panels 400 can be sized for any particular fume hood so as to reduce air flow through the hood and achieve a higher face velocity (Air Flow=area of opening× air velocity).

Figure 2:
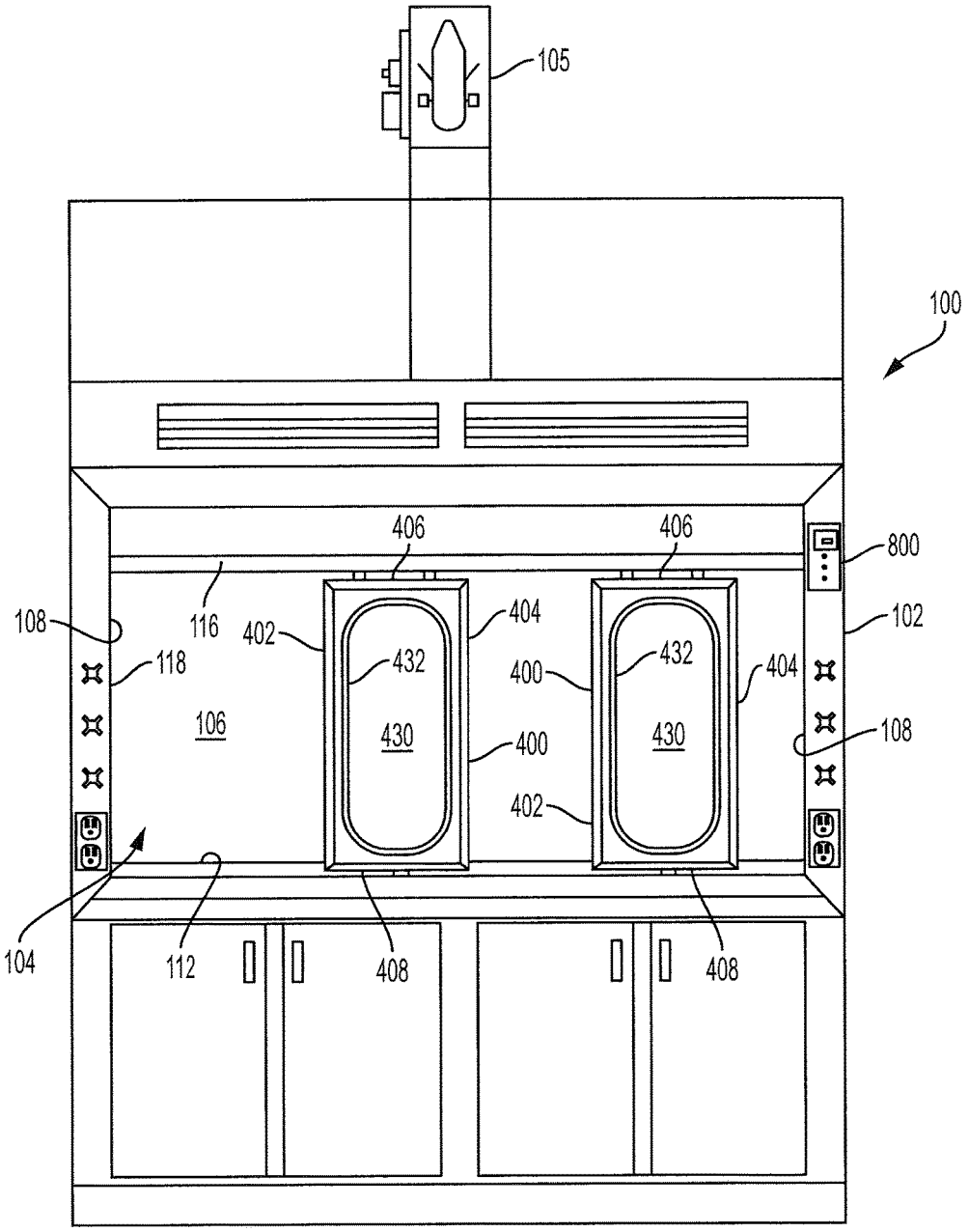
FIG. 2 is a front schematic view of a fume hood having horizontally sliding panels according to some embodiments of the present invention.
Figure 6:
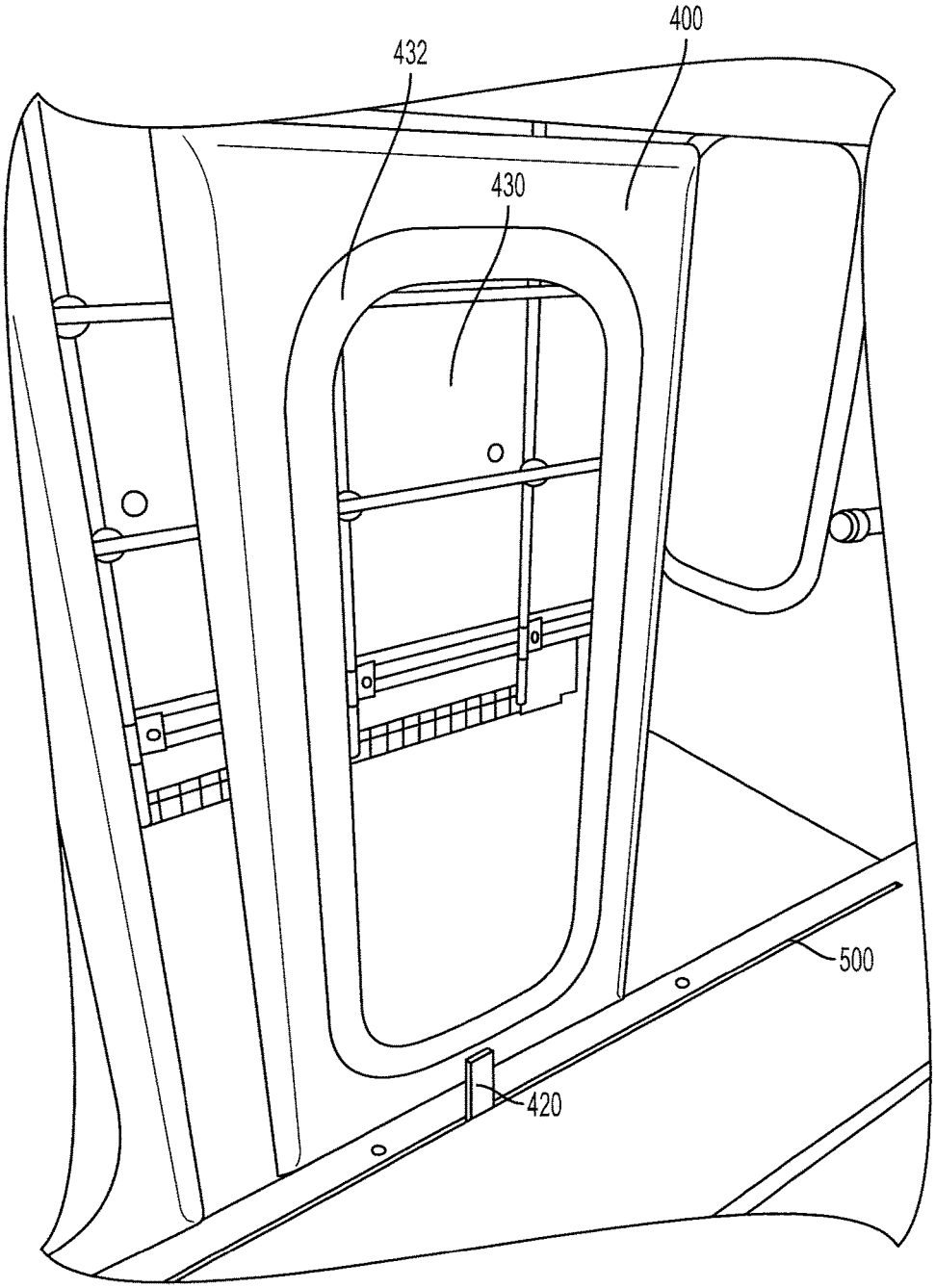
FIG. 6 is a front perspective view of one of the horizontally sliding panels of the fume hood of FIG. 4.
Figure 8:
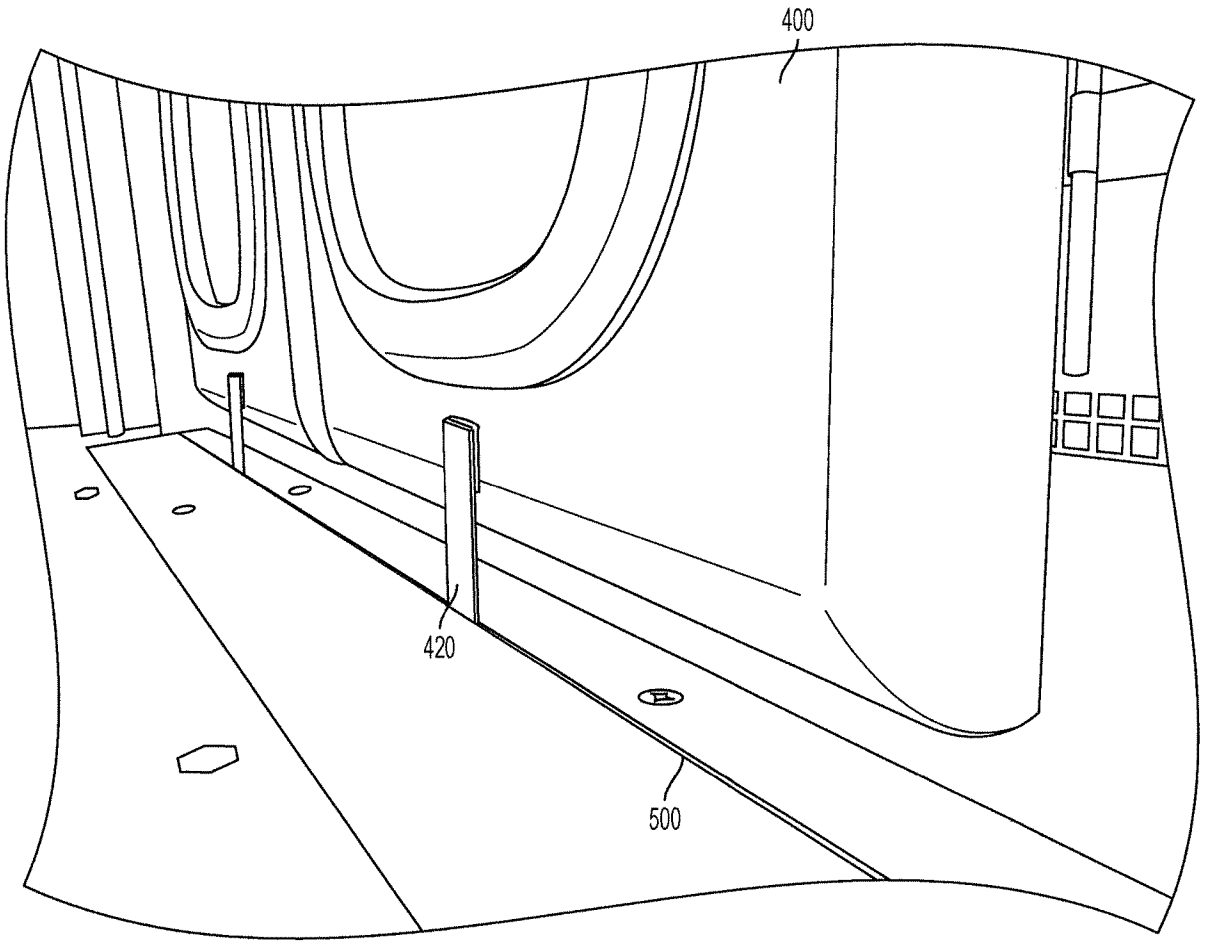
FIG. 8 is a front, partial perspective view of a lower portion of the horizontally sliding panel of FIG. 6 and illustrating a guiding member engaged with an elongated slot in an airfoil assembly at the floor edge portion of the fume hood.

As illustrated in FIG. 2, the upper edge 406 of each horizontally sliding panel 400 is spaced apart from an upper portion of the access opening 118, and the lower edge 408 of each horizontally sliding panel 400 is spaced apart from a lower portion of the access opening 118. Each horizontally sliding panel 400 includes a guide member 420 that extends downwardly from a lower portion of the panel 400 and that cooperates with an elongated slot 500 in the chamber 104, as illustrated in FIGS. 6 and 8. The guide member 420 maintains the panel 400 in the same plane as it is moved horizontally across the face of the chamber opening 118. In the illustrated embodiment, the elongated slot 500 is in a portion of the airfoil 130 on the edge portion 114 of the work space floor 112. However, in other embodiments not having an airfoil 130 on the edge portion 114 of the work space floor 112, the guide member may cooperate with an elongated slot in the work space floor 112 or other structural member of the fume hood 100.

Figure 10:
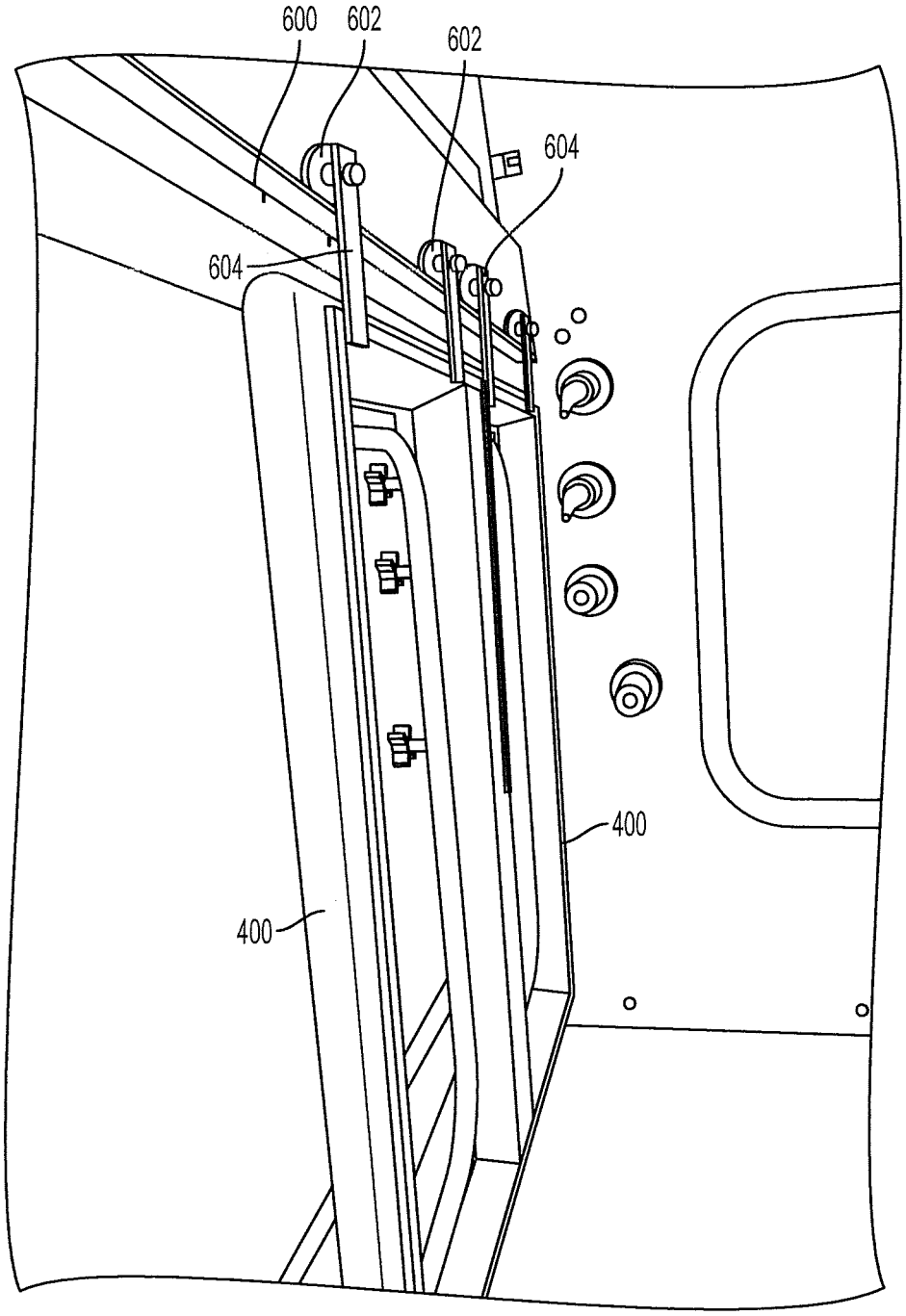
FIG. 10 is a rear perspective view of the horizontally sliding panels of FIG. 4 that illustrates a horizontal supporting track above the opening of the fume hood that movably supports the panels.
Figure 11:
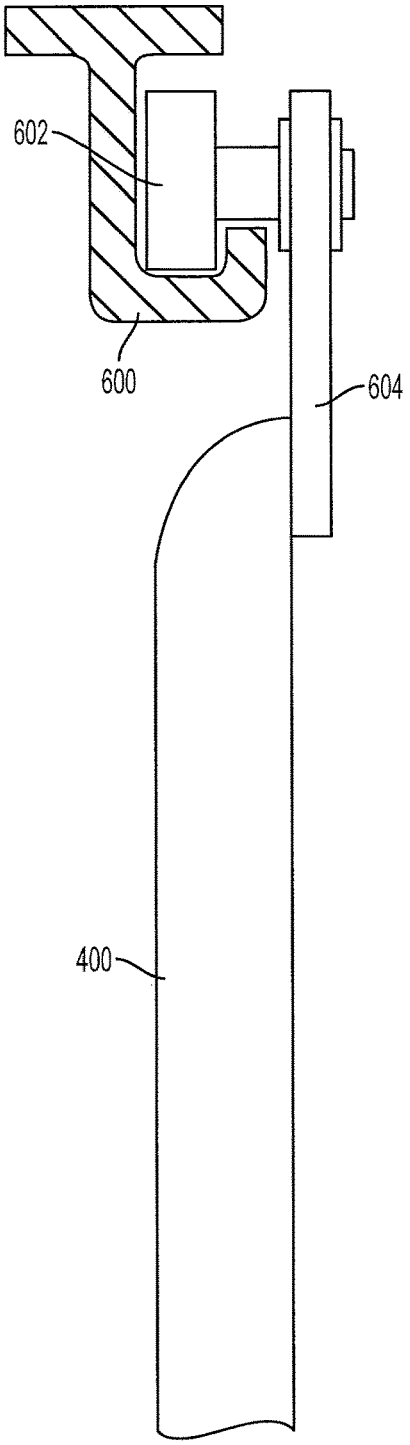
FIG. 11 is a sectional view of one of the horizontally movable panels of FIG. 10 and the supporting track.

Referring to FIGS. 10 and 11, the illustrated fume hood 100 includes a horizontal track 600 disposed above the chamber access opening 118. A pair of spaced support rollers 602 are connected to an upper portion of each horizontally sliding panel 400 and are engagable with the horizontal track 600 to permit horizontal sliding movement of each horizontally sliding panel 400. In the illustrated embodiment, each roller 602 is connected to an upper portion of a panel 400 via a structural member 604 that is welded or otherwise secured (e.g., via fasteners, etc.) to the panel 400. The horizontal track 600 may have an aerodynamic configuration and, in some embodiments, the track may be enclosed so as to shield the track and wheels from the collection of debris and exposure to corrosive airborne effluent generated in the hood 100.

Figure 21C:
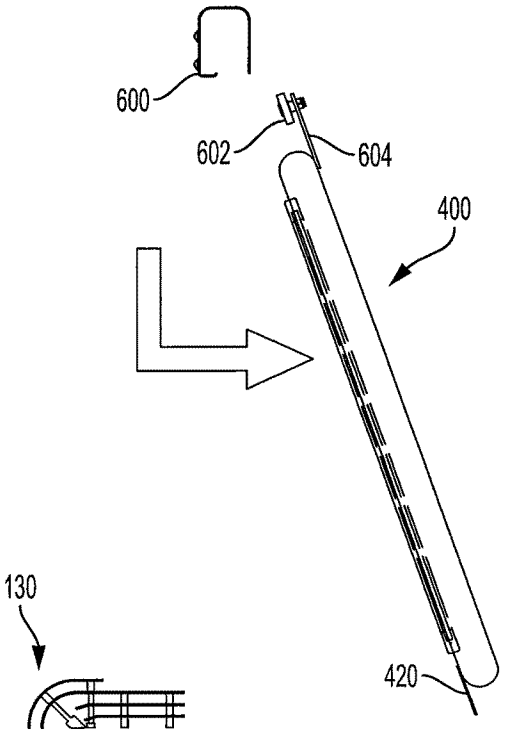
FIGS. 21A-21C illustrate a horizontally sliding panel being inwardly tilted and removed according to some embodiments of the present invention.
Figure 21B:
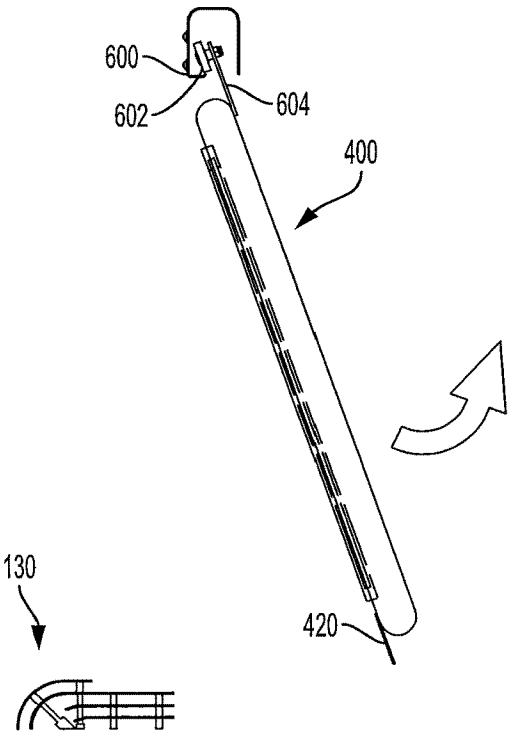
Figure 21A:
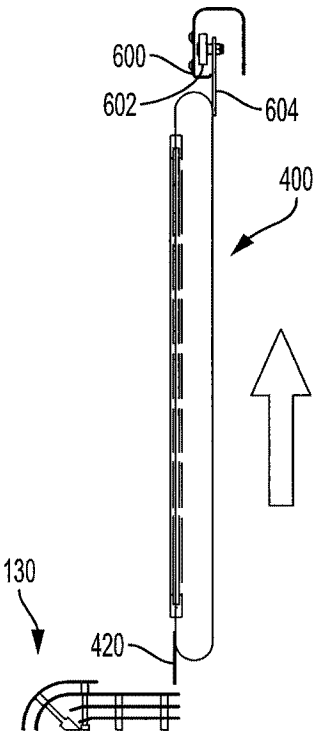

Each horizontally sliding panel 400 in the illustrated embodiment is inwardly tiltable and removable by a person without the use of tools, as illustrated in FIGS. 21A-21C. Each horizontally sliding panel 400 can be removed by lifting the panel 400 upwardly (FIG. 21A) so that the guide member 420 disengages from the slot 500 (FIG. 6), tilting the bottom of the panel 400 forward (FIG. 21B), and then gently pulling the panel 400 down (FIG. 21C).

Figure 9:
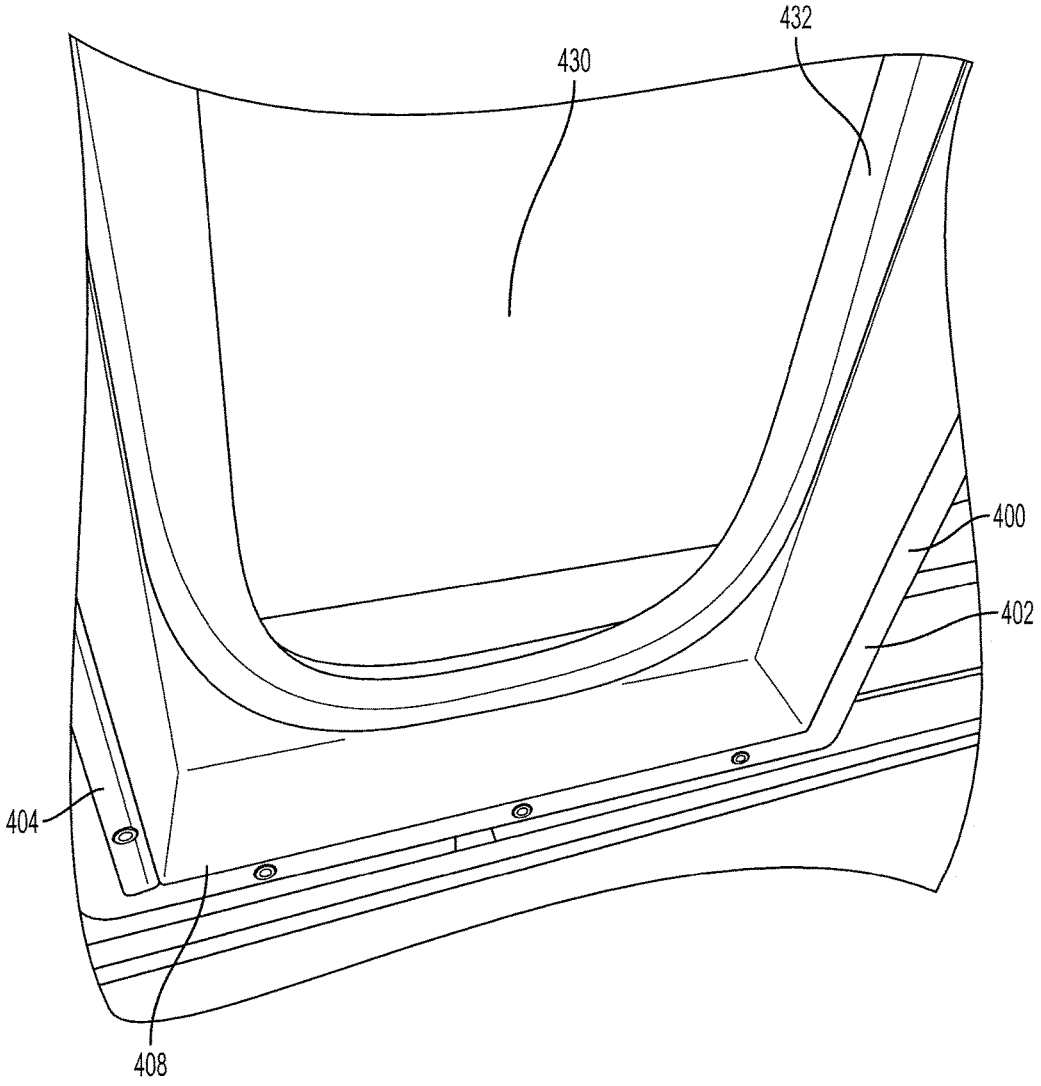
FIG. 9 is a rear, partial perspective view of a lower portion of the horizontally sliding panel of FIG. 6.

In the illustrated embodiment, each horizontally sliding panel 400 includes transparent safety glass 430 encased in a rubber, leak-tight gasket 432. In addition, and as best illustrated in FIG. 9, all four edges 402, 404, 406, 408 of each horizontally sliding panel 400 curve around to the back by about one hundred eighty degrees (180°) and then the opening in the back of the panel 400 is closed by bending ninety degrees (90°) and touch the back of the front surface. The curved edges are aerodynamically designed to help shed vortices and prevent accumulation of concentrations on the inside edge of the panels typical of common horizontal panels and shields. The curved edges along with the width and height are ergonomically superior to common panels that are often sharp edged and too wide or too narrow to reach around and use as an effective shield to prevent being splashed or to stop and divert explosive flying debris.

In some embodiments, the horizontally sliding panels 400 are constructed of stainless steel, although other materials may be used without limitation. The ergonomic horizontally sliding panels 400 with the leak tight safety glass panels 430 provide effective barriers to provide better protection of user when they stand in front of the panels 400 and reach around into the chamber 104. Spills, splashes, fires and explosions are common in fume hoods and the safety glass and rigid stainless steel structure can provide a greater degree of protection.

In some embodiments of the present invention, a sensor or monitor 800 can be installed on a fume hood to detect removal of a horizontally sliding panel 400 and/or an unsafe reduction in air flow or inadequate face velocity.

Referring to FIGS. 14 and 15, the illustrated fume hood 100 is fitted with two pair of horizontally sliding panels 400. A dual horizontal track 600 is disposed above the chamber access opening 118. A pair of spaced support rollers 602 are connected to an upper portion of each horizontally sliding panel 400 and are engagable with a respective horizontal track 600 to permit horizontal sliding movement of each horizontally sliding panel 400. The two tracks 600 are arranged such that two of the panels 400 slide in the same plane and the other two panels 400 slide in a different plane adjacent to the other plane.

In the embodiment of FIGS. 14 and 15, the fume hood 100 does not include a vertical panel. Also in this embodiment, an airfoil assembly 700 similar to airfoil assembly 200 is positioned at an upper portion of the access opening 118 and extends substantially the entire span of the access opening 118. The airfoil assembly 700 has a low profile such that it does not hinder use of the fume hood 100 and does not form a barrier to the movement of objects into and out of the chamber 104. However, embodiments of the present invention do not require an airfoil assembly 700.

Figure 16:
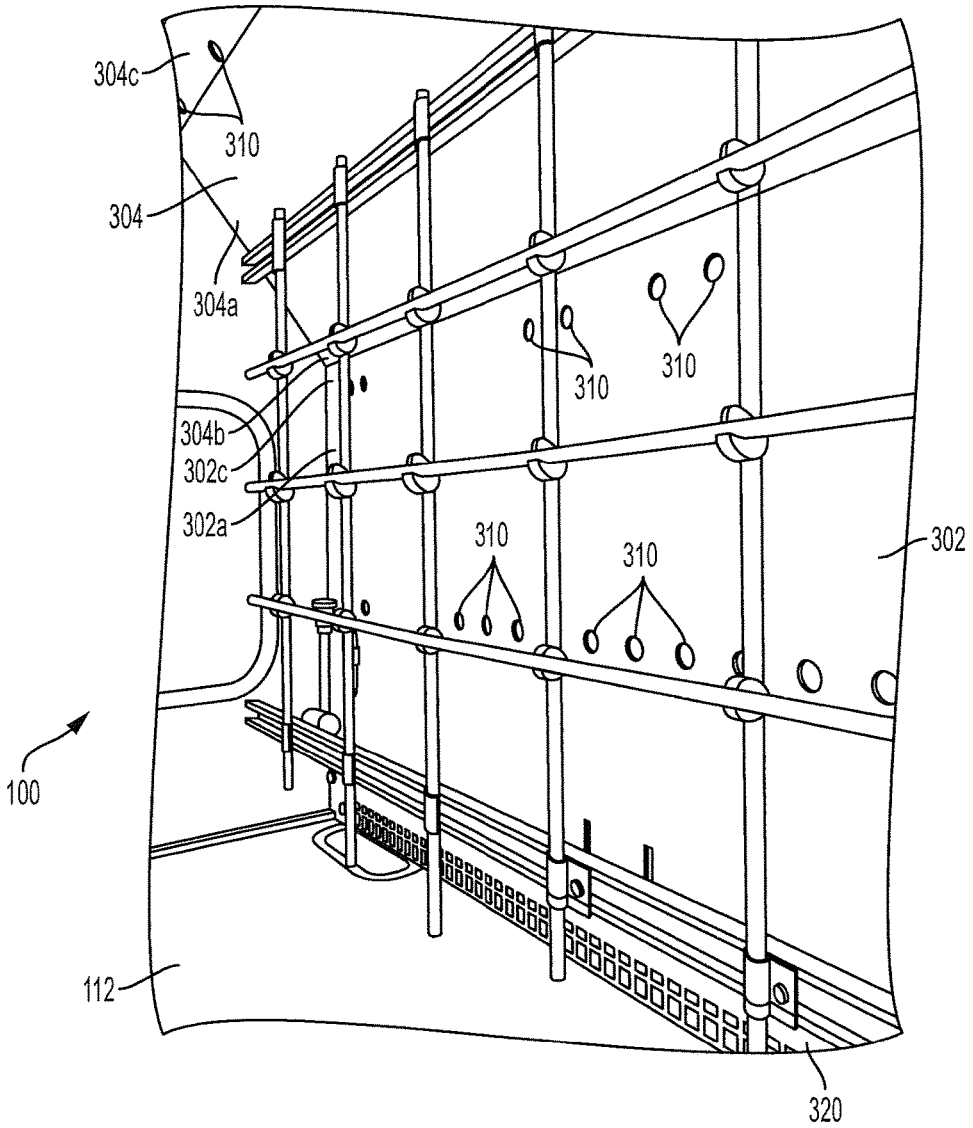
FIG. 16 is a perspective view of a baffle assembly for a fume hood, according to some embodiments of the present invention.
Figure 17:
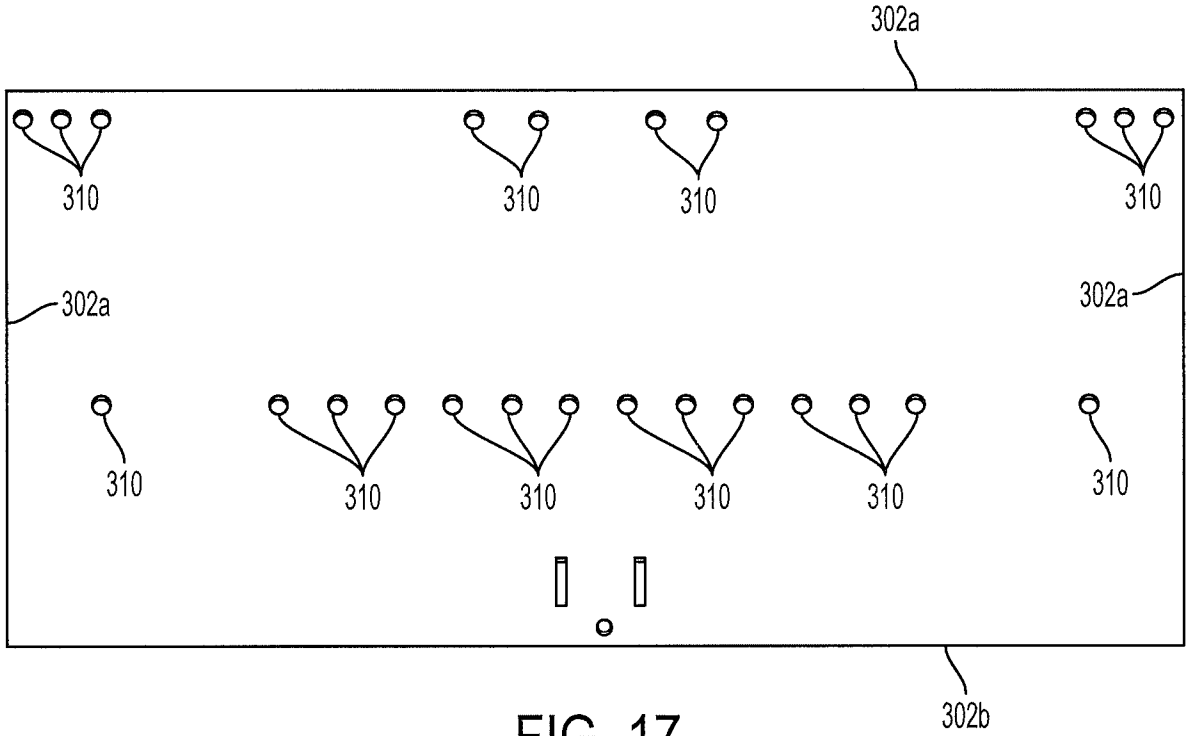
FIG. 17 is a front view of the baffle assembly lower panel.

Referring now to FIGS. 3A-3B and 16, the illustrated fume hood 100 includes a baffle assembly 300 located in front of the chamber rear wall 106. The illustrated baffle assembly 300 includes a rectangular lower panel 302 and a rectangular upper panel 304. The lower panel 302 has opposite side edges 302*a* attached to the respective chamber side walls 108 and a lower edge 302*b* spaced apart from the chamber floor 112. The upper panel 304 has opposite side edges 304*a* (only one illustrated) attached to the respective chamber side walls 108, a lower edge 304*b* attached to an upper portion 302*c* of the lower panel 302, and an opposite upper edge 304*c* attached to the chamber ceiling 110. Both the upper and lower panels 304, 302 include a plurality of air-exit apertures 310 formed therethrough.

The illustrated baffle assembly 300 also includes an elongated grating 320 that covers a gap 314 between the lower panel lower edge 302*b* and the chamber floor 112. The grating 320 is provide to prevent debris and foreign objects from passing through the gap 314 between the lower panel lower edge 302*b* and the chamber floor 112.

Figure 18:
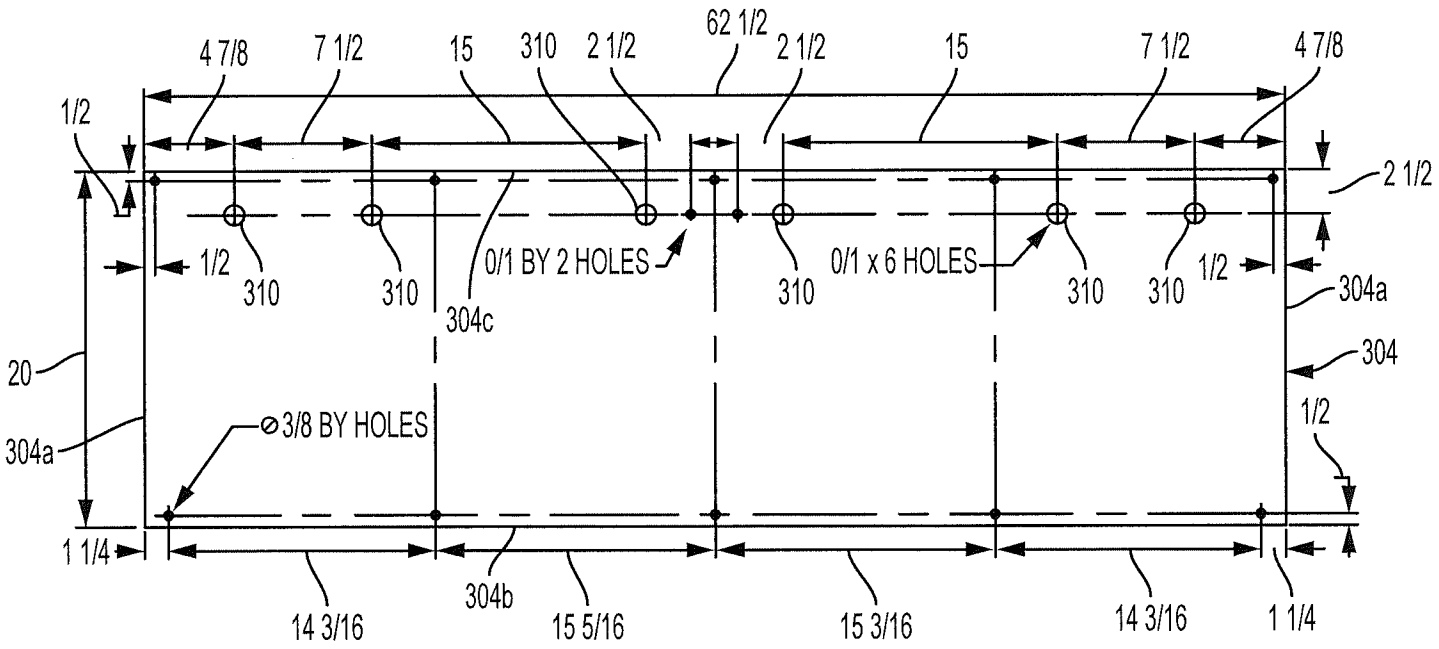
FIG. 18 illustrates a configuration of air-exit apertures for the baffle assembly upper panel of FIG. 16, according to some embodiments of the present invention.
Figure 19:
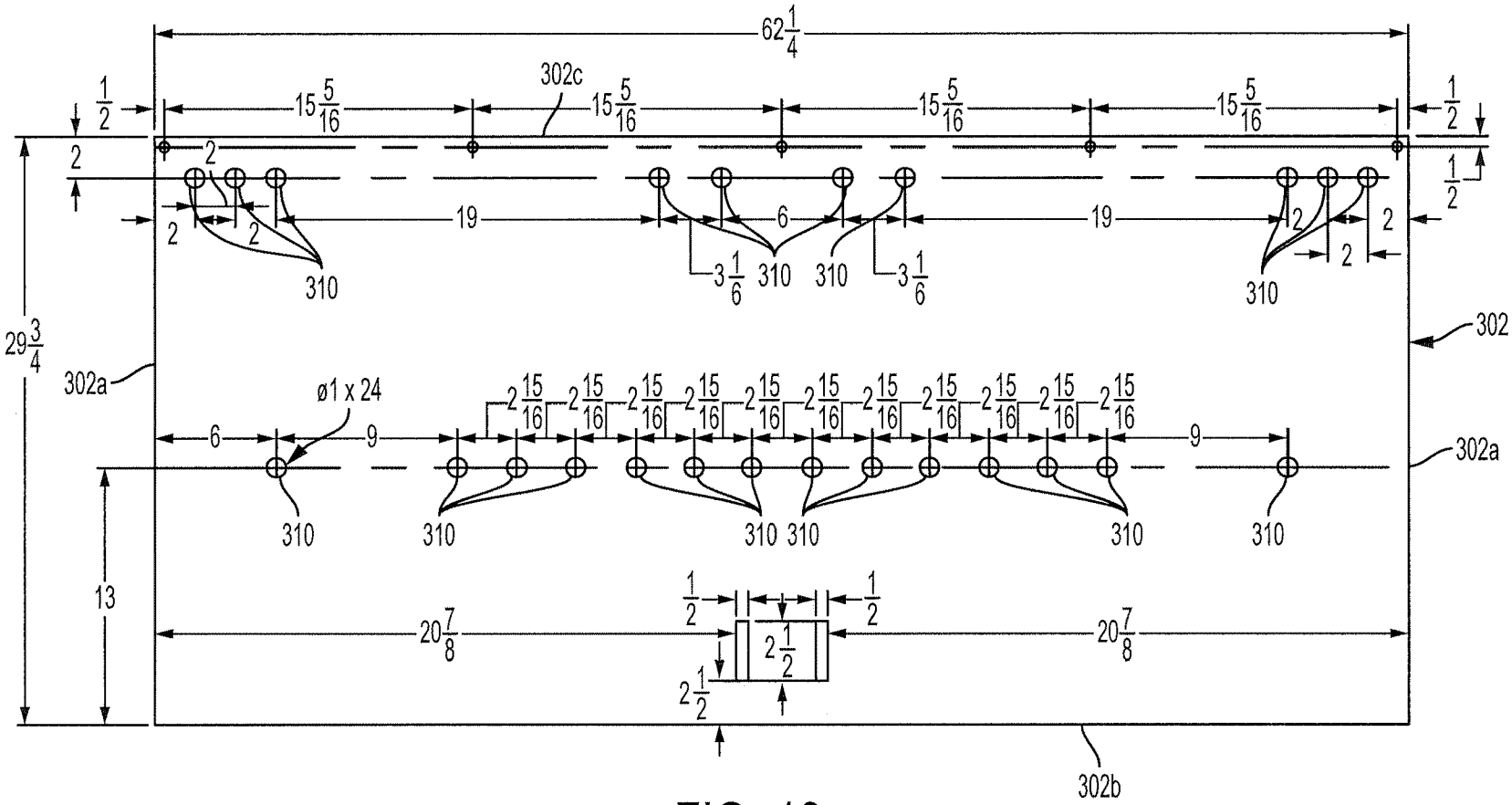
FIG. 19 illustrates a configuration of air-exit apertures for the baffle assembly lower panel of FIG. 16, according to some embodiments of the present invention.

FIG. 18 illustrates a configuration of air-exit apertures 310 for the baffle assembly upper panel 304, according to some embodiments of the present invention, and FIG. 19 illustrates a configuration of air-exit apertures 310 for the baffle assembly lower panel 302, according to some embodiments of the present invention. However, embodiments of the present invention are not limited to the illustrated configuration or number of air-exit apertures 310 in the upper and lower panels 304, 302. Various numbers and configurations of air-exit apertures 310 are possible.

Figure 20:
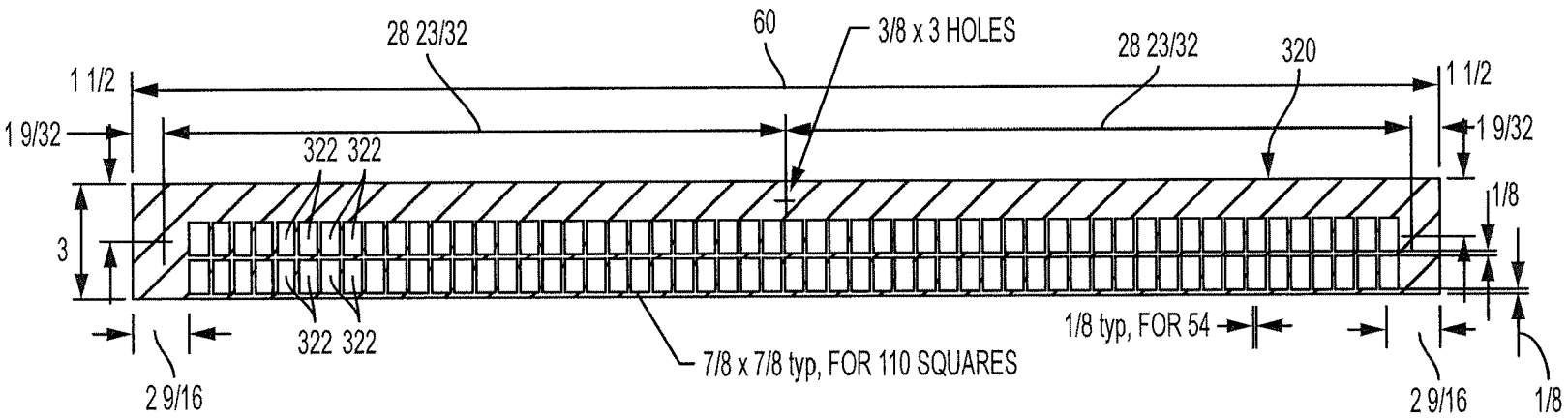
FIG. 20 is a front view of a grating utilized with the baffle assembly of FIG. 16, according to some embodiments of the present invention.

FIG. 20 is a front view of a grating utilized with the baffle assembly of FIG. 16, according to some embodiments of the present invention. The illustrated grating 320 includes two rows of air-exit apertures 322. However, embodiments of the present invention are not limited to the illustrated configuration or number of air-exit apertures 322. Various numbers and configurations of air-exit apertures 322 are possible.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

That which is claimed is:

1. A fume hood adapted to be connected to an exhaust system, the fume hood comprising:

a ventilated chamber having an access opening; and at least one horizontally sliding panel at the access opening that is configured to cover and uncover portions of the access opening, wherein the at least one horizontally sliding panel has a peripheral edge that convexly curves into the chamber towards a centerline of the at least one horizontally sliding panel, wherein air flow created within the chamber by the exhaust system causes the peripheral edge to produce controlled air flow patterns into the chamber, and wherein the at least one horizontally sliding panel is supported at an upper portion thereof and is inwardly tiltable and removable by a person without the use of tools.

2. The fume hood of claim 1, wherein the peripheral edge is convexly curved in an arc of between about ninety degrees and about one hundred eighty degrees (90°-180°).

3. The fume hood of claim 1, wherein the at least one horizontally sliding panel has a generally rectangular shape with opposite side edges and opposite upper and lower edges, wherein each edge convexly curves into the chamber towards a centerline of the at least one horizontally sliding panel.

4. The fume hood of claim 3, wherein each edge is convexly curved in an arc of between about ninety degrees and about one hundred eighty degrees (90°-180°).

5. The fume hood of claim 3, wherein the upper edge of the at least one horizontally sliding panel is spaced apart from an upper portion of the access opening, and wherein the lower edge of the at least one horizontally sliding panel is spaced apart from a lower portion of the access opening.

6. The fume hood of claim 1, further comprising a horizontal track disposed above the chamber access opening, and wherein a pair of spaced support rollers are connected to an upper portion of the at least one horizontally sliding panel and are engagable with the horizontal track to permit horizontal sliding movement of the at least one horizontally sliding panel.

7. The fume hood of claim 1, wherein the at least one horizontally sliding panel comprises a guide member extending downwardly from a lower portion thereof that cooperates with a lower portion of the chamber.

8. The fume hood of claim 1, wherein the chamber comprises a work space floor, wherein an edge portion of the floor extends outwardly to the access opening, and further comprising an elongated airfoil assembly attached to the floor edge portion, and wherein the at least one horizontally sliding panel comprises a guide member extending downwardly from a lower portion thereof that cooperates with an elongated slot in the elongated airfoil assembly.

9. The fume hood of claim 1, wherein the at least one horizontally sliding panel comprises a pair of horizontally sliding panels, each panel configured to slide within the same plane.

10. The fume hood of claim 1, wherein the at least one horizontally sliding panel comprises two pair of horizontally sliding panels, wherein the panels in each pair are arranged in bypass relation so as to slide in different respective planes.

11. The fume hood of claim 1, wherein at least a portion of the at least one horizontally sliding panel is transparent.

12. The fume hood of claim 1, wherein the ventilated chamber further comprises a rear wall, side walls, a ceiling, and a floor, and further comprising a baffle assembly located in front of the rear wall, the baffle assembly comprising:

a lower panel having opposite side edges attached to the respective chamber side walls and a lower edge spaced apart from the chamber floor, and wherein a plurality of air-exit apertures are formed within the lower panel; and an upper panel having opposite side edges attached to the respective chamber side walls, a lower edge attached to an upper portion of the lower panel, an opposite upper edge attached to the chamber ceiling, and wherein a plurality of air-exit apertures are formed within the upper panel.

13. The fume hood of claim 12, wherein the upper and lower panels are generally rectangular.

14. The fume hood of claim 12, further comprising an elongated grating covering a gap between the lower panel lower edge and the chamber floor.

15. A fume hood adapted to be connected to an exhaust system, the fume hood comprising:

a ventilated chamber having an access opening;

a vertically sliding sash at the access opening that is movable between raised and lowered positions; and at least one horizontally sliding panel at the access opening that is movable independently of the vertically sliding sash and that is configured to cover and uncover portions of the access opening, wherein the at least one horizontally sliding panel has a peripheral edge that convexly curves into the chamber towards a centerline of the at least one horizontally sliding panel, wherein at least a portion of the at least one horizontally sliding panel is transparent, and wherein the at least one horizontally sliding panel is supported at an upper portion thereof and is inwardly tiltable and removable by a person without the use of tools.

16. The fume hood of claim 15, wherein the peripheral edge is convexly curved in an arc of between about ninety degrees and about one hundred eighty degrees (90°-180°).

17. The fume hood of claim 15, wherein an upper portion of the at least one horizontally sliding panel is spaced apart from an upper portion of the access opening, and a lower portion of the at least one horizontally sliding panel is spaced apart from a lower portion of the access opening.

18. The fume hood of claim 15, further comprising a horizontal track disposed above the chamber access opening, and wherein a pair of spaced support rollers are connected to an upper portion of the at least one horizontally sliding panel and are engagable with the horizontal track to permit horizontal sliding movement of the at least one horizontally sliding panel.

19. The fume hood of claim 15, wherein the at least one horizontally sliding panel comprises a guide member extending downwardly from a lower portion thereof that cooperates with a lower portion of the chamber.

20. The fume hood of claim 15, wherein the chamber comprises a work space floor, wherein an edge portion of the floor extends outwardly to the access opening, and further comprising an elongated airfoil assembly attached to the floor edge portion, and wherein the at least one horizontally sliding panel comprises a guide member extending downwardly from a lower portion thereof that cooperates with an elongated slot in the elongated airfoil assembly.

21. The fume hood of claim 15, wherein the at least one horizontally sliding panel comprises a pair of horizontally sliding panels, each panel configured to slide within the same plane.

22. The fume hood of claim 15, wherein the at least one horizontally sliding panel comprises two pair of horizontally sliding panels, wherein the panels in each pair are arranged in bypass relation so as to slide in different respective planes.

23. The fume hood of claim 15, wherein the at least one horizontally sliding panel is positioned behind the vertically sliding sash, and wherein the vertically sliding sash comprises an elongated airfoil assembly attached to a lower edge portion thereof.

24. The fume hood of claim 15, wherein the ventilated chamber further comprises a rear wall, side walls, a ceiling, and a floor, and further comprising a baffle assembly located in front of the rear wall, the baffle assembly comprising:

a lower panel having opposite side edges attached to the respective chamber side walls and a lower edge spaced apart from the chamber floor, and wherein a plurality of air-exit apertures are formed within the lower panel; and an upper panel having opposite side edges attached to the respective chamber side walls, a lower edge attached to an upper portion of the lower panel, an opposite upper edge attached to the chamber ceiling, and wherein a plurality of air-exit apertures are formed within the upper panel.

25. The fume hood of claim 24, wherein the upper and lower panels are generally rectangular.

26. The fume hood of claim 24, further comprising an elongated grating covering a gap between the lower panel lower edge and the chamber floor.

* * * * *